US011213095B2

(12) United States Patent
Avar et al.

(10) Patent No.: US 11,213,095 B2
(45) **Date of Patent: *Jan. 4, 2022**

(54) ARTICLE WITH SOLE STRUCTURE HAVING MULTIPLE COMPONENTS

(71) Applicant: NIKE, Inc., Beaverton, OR (US)

(72) Inventors: Eric P. Avar, Lake Oswego, OR (US); Nadia M. Panian, Beaverton, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 343 days.

This patent is subject to a terminal disclaimer.

(21) Appl. No.: 16/427,704

(22) Filed: May 31, 2019

(65) Prior Publication Data

US 2019/0281926 A1 Sep. 19, 2019

Related U.S. Application Data

(63) Continuation of application No. 14/467,167, filed on Aug. 25, 2014, now Pat. No. 10,342,291.

(51) Int. Cl.

| | |
|---|---|
| ***A43B 13/22*** | (2006.01) |
| ***A43B 13/12*** | (2006.01) |
| ***A43B 13/14*** | (2006.01) |

(52) U.S. Cl.

CPC ..... *A43B 13/223* (2013.01); *A43B 13/12* (2013.01); *A43B 13/127* (2013.01); *A43B 13/141* (2013.01); *A43B 13/22* (2013.01); *A43B 13/226* (2013.01)

(58) Field of Classification Search

CPC ..... A43B 13/223; A43B 13/12; A43B 13/141; A43B 13/22; A43B 13/226; A43B 13/127; A43B 13/14; A43B 13/181

See application file for complete search history.

(56) References Cited

U.S. PATENT DOCUMENTS

| | | | |
|---|---|---|---|
| 2,155,166 | A | 4/1939 | Kraft |
| 2,553,616 | A | 5/1951 | Walls |
| 3,444,632 | A | 5/1969 | Hack et al. |
| 3,748,951 | A | 7/1973 | Orndorff, Jr. |
| 3,888,026 | A | 6/1975 | Dassler |
| 4,007,549 | A | 2/1977 | Moore |
| 4,130,947 | A | 12/1978 | Denu |

(Continued)

FOREIGN PATENT DOCUMENTS

| | | | |
|---|---|---|---|
| CN | 101557733 | A | 10/2009 |
| CN | 102215710 | A | 10/2011 |

(Continued)

OTHER PUBLICATIONS

Nov. 11, 2015—(WO) ISR—App. No. PCT/US2015/033491.
Mar. 9, 2017—(WO) IPRP and Written Opinion—App. No. PCT/US15/033491.

*Primary Examiner* — Shaun R Hurley
*Assistant Examiner* — Bao-Thieu L Nguyen
(74) *Attorney, Agent, or Firm* — Banner & Witcoff, Ltd.

(57) ABSTRACT

An article of footwear has a sole structure with multiple components. The sole structure includes a midsole member, an outsole member and an exterior support member. The midsole member and the outsole member have corresponding grooves. The exterior support member provides reinforcement for the midsole member. The outsole member includes a plurality of bristle members.

20 Claims, 18 Drawing Sheets

(56) References Cited

U.S. PATENT DOCUMENTS

| | | | |
|---|---|---|---|
| 4,161,828 | A | 7/1979 | Benseler et al. |
| 4,194,310 | A | 3/1980 | Bowerman |
| 4,223,459 | A | 9/1980 | Riggs |
| 4,274,211 | A | 6/1981 | Funck |
| 4,319,412 | A | 3/1982 | Muller et al. |
| 4,356,643 | A | 11/1982 | Kester et al. |
| 4,402,145 | A | 9/1983 | Dassler |
| 4,615,126 | A | 10/1986 | Mathews |
| 4,617,745 | A | 10/1986 | Batra |
| 4,631,842 | A | 12/1986 | Koskela |
| 4,651,445 | A | 3/1987 | Hannibal |
| D293,271 | S | 12/1987 | Lussier |
| 4,741,114 | A | 5/1988 | Stubblefield |
| 4,782,604 | A | 11/1988 | Wen-Shown |
| 4,845,863 | A | 7/1989 | Yung-Mao |
| 5,012,597 | A | 5/1991 | Thomasson |
| 5,224,279 | A | 7/1993 | Agnew |
| 5,313,718 | A | 5/1994 | McMahon et al. |
| 5,384,973 | A | 1/1995 | Lyden |
| 5,400,526 | A | 3/1995 | Sessa |
| 5,423,135 | A | 6/1995 | Poole et al. |
| 5,483,760 | A | 1/1996 | Kataoka et al. |
| D390,690 | S | 2/1998 | Murai et al. |
| 5,829,172 | A | 11/1998 | Kaneko |
| 5,896,680 | A | 4/1999 | Kim et al. |
| 5,987,782 | A | 11/1999 | Bramani |
| 6,065,230 | A | 5/2000 | James |
| 6,076,283 | A | 6/2000 | Boie |
| 6,115,945 | A | 9/2000 | Ellis, III |
| 6,266,896 | B1 | 7/2001 | Liu |
| 6,295,742 | B1 | 10/2001 | Bathum |
| D467,061 | S | 12/2002 | Della Valle |
| D479,643 | S | 9/2003 | O'Shea et al. |
| 6,701,643 | B2 | 3/2004 | Geer et al. |
| 6,990,755 | B2 | 1/2006 | Hatfield et al. |
| 7,225,564 | B1 | 6/2007 | Gillespie |
| 7,264,599 | B1 | 9/2007 | Milligan |
| D553,833 | S | 10/2007 | Walden |
| 7,537,035 | B2 | 5/2009 | Matsuda et al. |
| 7,665,229 | B2 | 2/2010 | Kilgore et al. |
| 8,186,079 | B2 | 5/2012 | Carboy et al. |
| 8,272,149 | B2 | 9/2012 | Cooper et al. |
| 8,322,050 | B2 | 12/2012 | Lubart |
| 8,375,604 | B2 | 2/2013 | Eder et al. |
| 8,387,281 | B2 | 3/2013 | Loverin et al. |
| 8,393,028 | B2 | 3/2013 | Namkook et al. |
| 8,464,383 | B2 | 6/2013 | Sing |
| 8,505,220 | B2 | 8/2013 | James et al. |
| 8,631,590 | B2 | 1/2014 | Droege et al. |
| 8,776,403 | B2 | 7/2014 | Eder et al. |
| 8,991,075 | B2 | 3/2015 | Chenciner |
| 9,015,962 | B2 | 4/2015 | Boudreau et al. |
| 9,144,264 | B2 | 9/2015 | Marvin et al. |
| 9,491,985 | B2 | 11/2016 | Lubart |
| 9,504,293 | B2 | 11/2016 | Tsang |
| 9,510,635 | B2 | 12/2016 | Dojan et al. |
| 9,591,886 | B2 | 3/2017 | Daniels |
| 9,655,403 | B2 | 5/2017 | Farris |
| 9,894,958 | B2 | 2/2018 | Cheney et al. |
| 10,342,291 | B2 * | 7/2019 | Avar ..... A43B 13/22 |
| 2003/0033731 | A1 | 2/2003 | Sizemore |
| 2003/0093920 | A1 | 5/2003 | Greene et al. |
| 2003/0131496 | A1 | 7/2003 | Nakano |
| 2004/0148803 | A1 | 8/2004 | Grove et al. |
| 2004/0194345 | A1 | 10/2004 | Koo |
| 2005/0076536 | A1 | 4/2005 | Hatfield et al. |
| 2005/0081405 | A1 | 4/2005 | Healy |
| 2006/0137221 | A1 | 6/2006 | Dojan et al. |
| 2007/0017124 | A1 | 1/2007 | Koo et al. |
| 2007/0169376 | A1 | 7/2007 | Hatfield et al. |
| 2008/0201992 | A1 | 8/2008 | Avar et al. |
| 2008/0229617 | A1 | 9/2008 | Johnson et al. |
| 2009/0025260 | A1 | 1/2009 | Nakano |
| 2009/0307932 | A1 | 12/2009 | Kirby et al. |
| 2010/0101111 | A1 | 4/2010 | McDonnell |
| 2010/0154257 | A1 | 6/2010 | Bosomworth et al. |
| 2010/0199523 | A1 | 8/2010 | Mayden et al. |
| 2010/0212185 | A1 | 8/2010 | Cooper et al. |
| 2010/0299965 | A1 | 12/2010 | Avar et al. |
| 2011/0035963 | A1 | 2/2011 | Baker et al. |
| 2011/0047834 | A1 | 3/2011 | Baker et al. |
| 2011/0192056 | A1 | 8/2011 | Geser et al. |
| 2011/0314697 | A1 | 12/2011 | Chang |
| 2012/0048663 | A1 | 3/2012 | McDonnell |
| 2012/0073160 | A1 | 3/2012 | Marvin et al. |
| 2012/0180336 | A1 | 7/2012 | Sullivan et al. |
| 2013/0000152 | A1 | 1/2013 | Cooper et al. |
| 2013/0019505 | A1 | 1/2013 | Borel et al. |
| 2013/0074370 | A1 | 3/2013 | Park |
| 2013/0118036 | A1 | 5/2013 | Gibson |
| 2013/0232823 | A1 | 9/2013 | Kasprzak |
| 2013/0283641 | A1 | 10/2013 | Rapf et al. |
| 2014/0013624 | A1 | 1/2014 | Stockbridge et al. |
| 2014/0096414 | A1 | 4/2014 | Koo et al. |
| 2014/0115925 | A1 | 5/2014 | Hurd et al. |
| 2014/0123522 | A1 | 5/2014 | Rustam et al. |
| 2014/0150297 | A1 | 6/2014 | Holmes et al. |
| 2014/0259784 | A1 | 9/2014 | Jenkins et al. |
| 2014/0259802 | A1 | 9/2014 | Daniels |
| 2014/0325876 | A1 | 11/2014 | Dodge et al. |
| 2015/0047222 | A1 | 2/2015 | Rushbrook |
| 2015/0068063 | A1 | 3/2015 | Farris |
| 2015/0075033 | A1 | 3/2015 | Cross et al. |
| 2015/0101215 | A1 | 4/2015 | Henderson et al. |
| 2015/0196087 | A1 | 7/2015 | Meschter et al. |
| 2015/0351487 | A1 | 12/2015 | Lukongwa et al. |
| 2016/0051012 | A1 | 2/2016 | Avar et al. |
| 2016/0058121 | A1 | 3/2016 | Langvin et al. |
| 2016/0192739 | A1 | 7/2016 | Hoffer et al. |
| 2016/0219975 | A1 | 8/2016 | Wright |
| 2016/0227878 | A1 | 8/2016 | Lan |
| 2016/0270476 | A1 | 9/2016 | Avar et al. |
| 2017/0042288 | A1 | 2/2017 | Lawless |

FOREIGN PATENT DOCUMENTS

| | | | |
|---|---|---|---|
| DE | 2828561 | A1 | 1/1980 |
| DE | 3009381 | A1 | 9/1981 |
| GB | 2053658 | A | 2/1981 |
| WO | 2005006903 | A1 | 1/2005 |
| WO | 2008115743 | A1 | 9/2008 |
| WO | 2009146231 | A1 | 12/2009 |

* cited by examiner

ARTICLE WITH SOLE STRUCTURE HAVING MULTIPLE COMPONENTS

CROSS-REFERENCE TO RELATED APPLICATIONS

This application is a continuation of U.S. patent application Ser. No. 14/467,167, filed Aug. 25, 2014, entitled "Article With Sole Structure Having Multiple Components," all of which is herein incorporated by reference in its entirety.

BACKGROUND

The present embodiments relate generally to articles of footwear, and in particular to articles of footwear with sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY OF INVENTION

In one aspect, an article of footwear includes an upper and a sole structure, where the sole structure further includes a midsole member and an outsole member. The midsole member has a first midsole surface and a second midsole surface. The midsole member has a first thickness. The outsole member has a first outsole surface and a second outsole surface. The outsole member has a second thickness that is less than the first thickness. The first midsole surface includes an outer peripheral region and a central region disposed inwardly of the outer peripheral region. The midsole member includes a first midsole groove disposed in the first midsole surface and the midsole member includes a second midsole groove disposed in the first midsole surface, where the first midsole groove intersects the second midsole groove. A first end of the first midsole groove is disposed in the central region and a second end of the first midsole groove is disposed in the central region. A first end of the second midsole groove is disposed in the central region and a second end of the second midsole groove is disposed in the central region. The outsole member includes a first outsole groove disposed in the second outsole surface and the outsole member includes a second outsole groove disposed in the second outsole surface, where the first outsole groove intersects the second outsole groove. The first midsole groove is approximately aligned with the first outsole groove and where the second midsole groove is approximately aligned with the second outsole groove.

In another aspect, an article of footwear includes an upper and a sole structure, where the sole structure further includes a midsole member and an exterior support member. The exterior support member includes a sidewall portion that extends around an outer perimeter portion of the midsole member. The midsole member has a surface including a plurality of grooves. The midsole member has a first stiffness and the exterior support member has a second stiffness. The second stiffness is greater than the first stiffness.

In another aspect, an article of footwear includes an upper and a sole structure, where the sole structure further includes a midsole member and an outsole member. The outsole member has an inner outsole surface and an outer outsole surface, the outer outsole surface being disposed further from an interior cavity of the upper than the inner outsole surface. The outsole member has a first outsole groove and a second outsole groove arranged in an approximately parallel configuration on the outsole member, and a third outsole groove and a fourth outsole groove arranged in an approximately parallel configuration on the outsole member. The first outsole groove intersects the third outsole groove and the fourth outsole groove and the second outsole groove intersects the third outsole groove and the fourth outsole groove. A traction region of the outsole member is bounded by the first outsole groove, the second outsole groove, the third outsole groove and the fourth outsole groove. The article of footwear also includes a plurality of bristle members disposed on the outer outsole surface of the outsole member, where each bristle member in the plurality of bristle members is configured to extend in a normal direction in the absence of forces being applied to the bristle member. The normal direction is a direction that is approximately perpendicular to the outer outsole surface of the outsole member. Each bristle member in the plurality of bristle members is configured to bend away from the normal direction when a force is applied to the bristle member by a ground surface.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
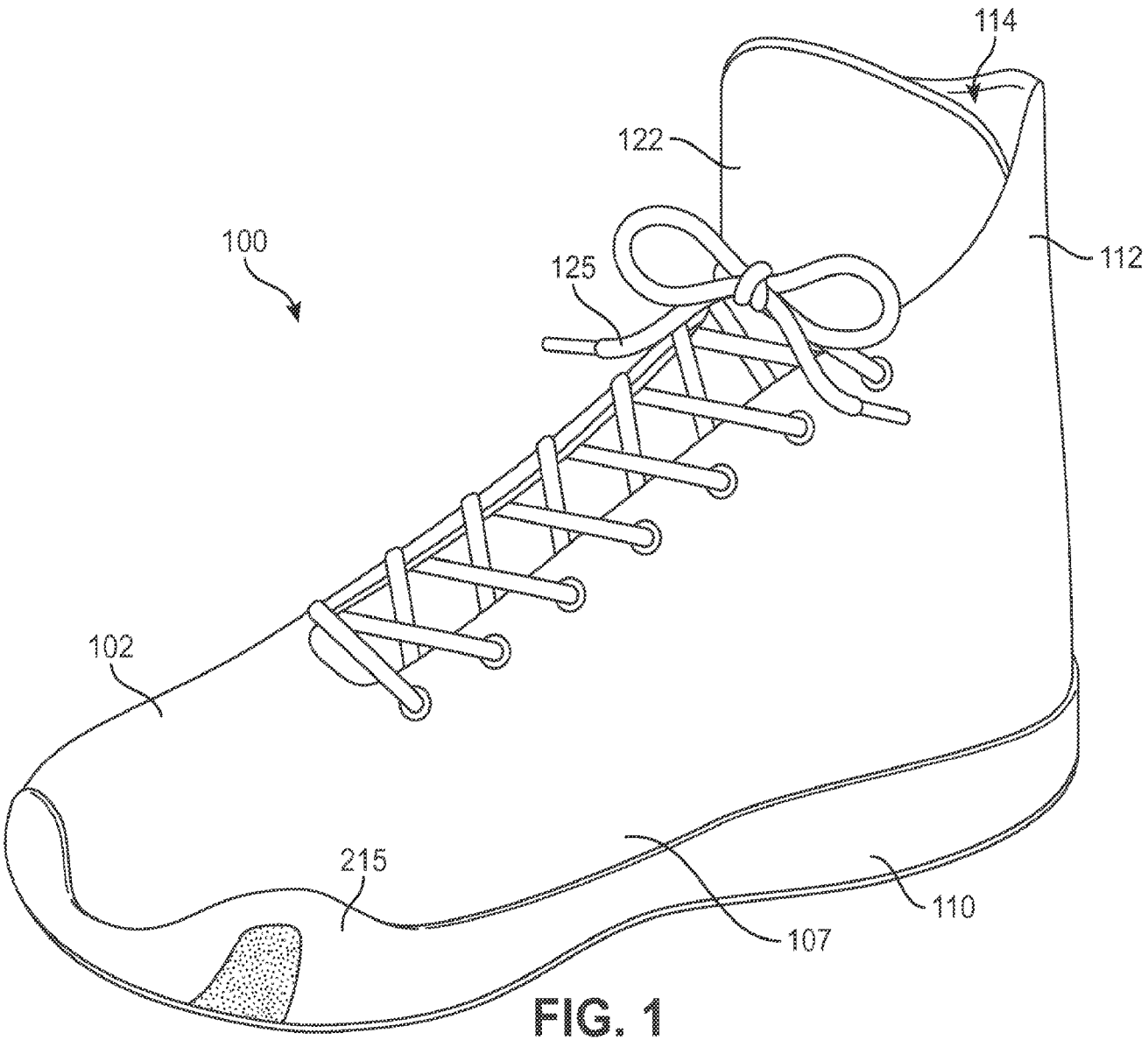
FIG. 1 is a schematic isometric view of an embodiment of an article of footwear including an upper and a sole structure.

FIG. 1 illustrates an isometric view of an embodiment of an article of footwear 100. Article of footwear 100, also referred to simply as article 100, may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments, article 100 may be configured as various other kinds of non-sports related footwear, including, but not limited to: slippers, sandals, high heeled footwear, and loafers.

Article 100 may include an upper 102 as well as a sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In at least some embodiments, upper 102 may be configured with a raised cuff portion 112 that wraps up high around the ankle to improve ankle support.

In some embodiments, upper 102 includes opening 114 that provides entry for the foot into an interior cavity of upper 102. In some embodiments, upper 102 may include a tongue 122 that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, hardwood flooring, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Figure 2:
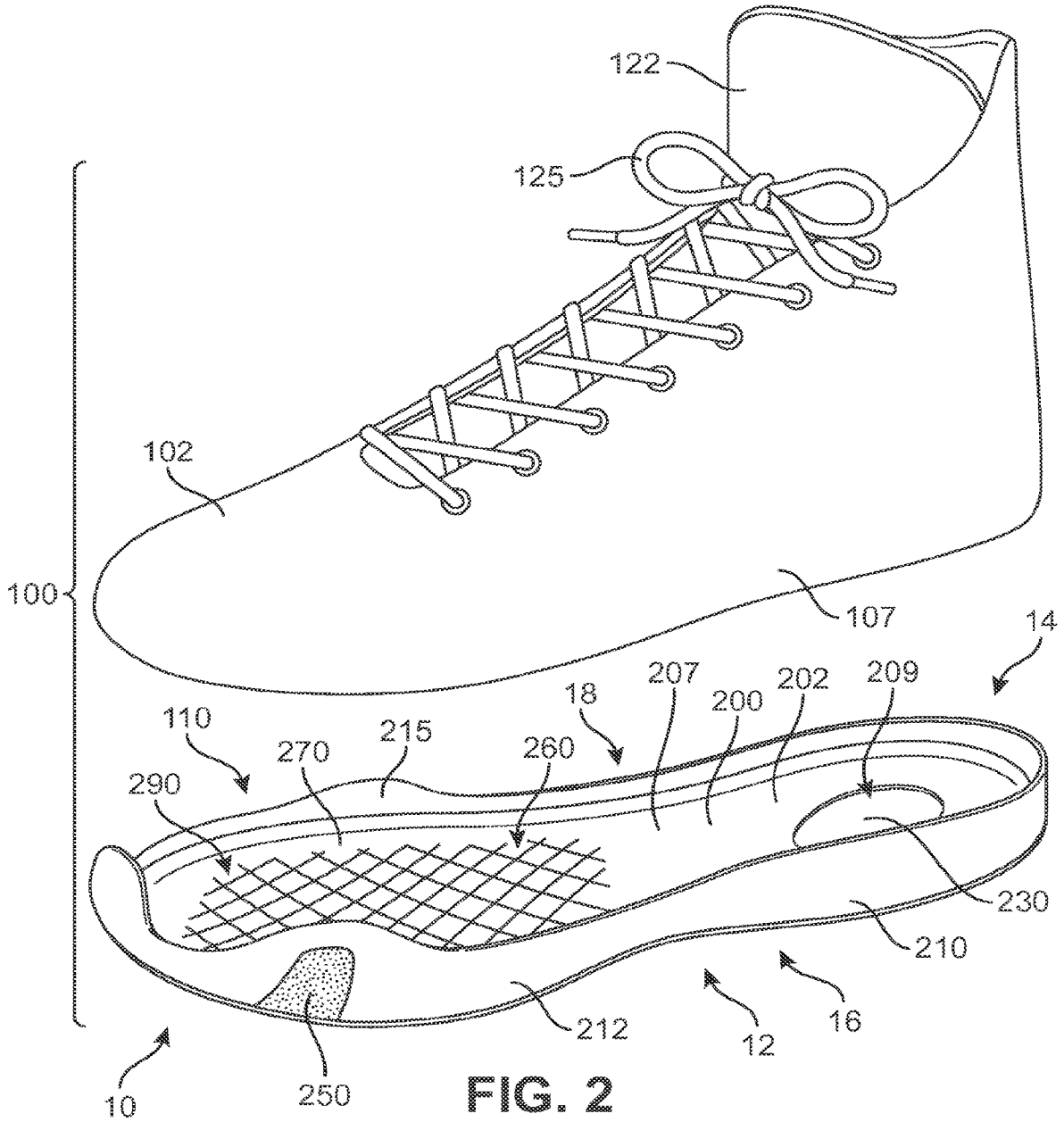
FIG. 2 is an exploded isometric view of the article of FIG. 1.

FIG. 2 is an exploded view of an embodiment of article 100, including upper 102 and sole structure 110. Referring to FIG. 2, for purposes of reference, sole structure 110 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole structure 110 may include lateral side 16 and medial side 18. In particular, lateral side 16 and medial side 18 may be opposing sides of sole structure 110. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole structure 110. Likewise, lateral side 16 and medial side 18 are intended to represent generally two sides of a sole structure, rather than precisely demarcating sole structure 110 into two halves. Moreover, throughout the embodiments, forefoot portion 10, midfoot portion 12, heel portion 14, lateral side 16 and medial side 18 may be used to refer to portions/sides of individual components of sole structure 110, including a midsole member, an outsole member, an exterior support member as well as possibly other components of sole structure 110.

For consistency and convenience, directional adjectives are employed throughout this detailed description corresponding to the illustrated embodiments. The term "longitudinal" as used throughout this detailed description and in the claims refers to a direction extending a length of a component (e.g., a sole structure). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where a sole structure is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. This detailed description makes use of these directional adjectives in describing a sole structure and various components of the sole structure.

Figure 3:
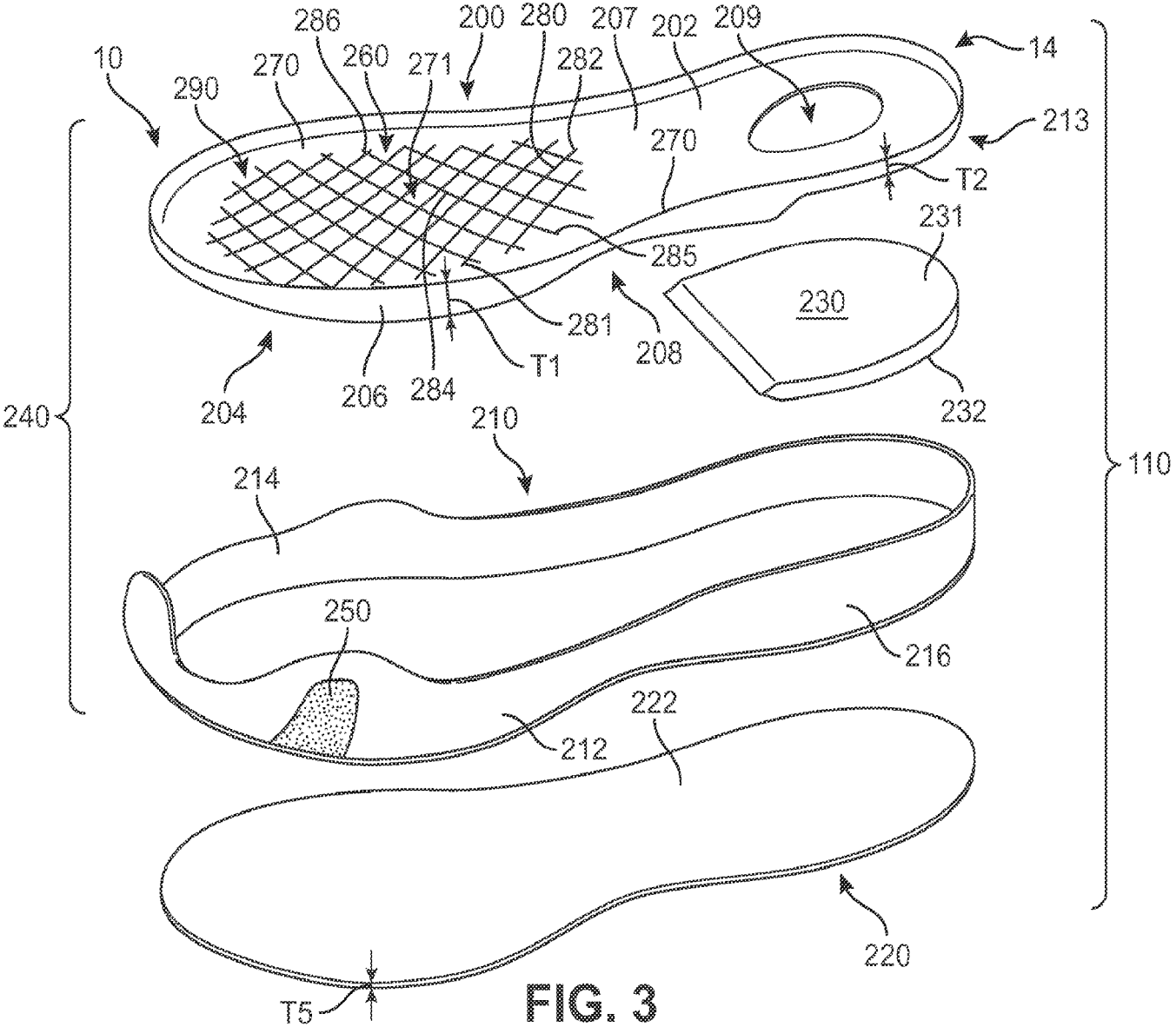
FIG. 3 is an exploded isometric view of an embodiment of a sole structure.

FIG. 3 illustrates an exploded isometric view of an embodiment of sole structure 110. For purposes of clarity, sole structure 110 is shown in isolation in FIG. 3, without upper 102. Referring to FIGS. 2-3, sole structure 110 may be configured with multiple components or members. In particular, in some embodiments, sole structure 110 may comprise a midsole member 200, an exterior support member 210, and an outsole member 220. Optionally, some embodiments may further incorporate a cushioning device 230.

Midsole member 200, exterior support member 210 and cushioning device 230 may together comprise a midsole assembly 240. Thus, in some embodiments, sole structure 110 can be characterized as comprising midsole assembly 240 and outsole member 220. Specifically, in at least some embodiments, midsole assembly 240 may provide cushioning, support, energy return as well as possibly other features to sole structure 110. Additionally, in some embodiments, outsole member 220 may be configured to provide traction as well as wear resistance for the ground facing surface of sole structure 110.

Referring now to FIG. 3, each component of sole structure 110 may be configured to provide desired properties for article of footwear 100. In some embodiments, midsole member 200 includes an inner midsole surface 202 as well as an outer midsole surface 204. Additionally, midsole member 200 includes a midsole sidewall surface 206 that extends between inner midsole surface 202 and outer midsole surface 204. When assembled within article 100, inner midsole surface 202 may be disposed proximally (i.e., closer to) an interior cavity of upper 102 than outer midsole surface 204. In some cases, inner midsole surface 202 may be in contact with an insole, strobel layer, removable insert or other layer or liner. It is also contemplated that in some embodiments inner midsole surface 202 could be configured to directly contact a foot (or sock) when article 100 is worn.

Midsole member 200 may also be associated with an outer perimeter portion 208 and a central portion 207. In particular, central portion 207 extends inwardly of outer perimeter portion 208. In some cases, outer perimeter portion 208 includes the outer perimeter surfaces of inner midsole surface 202, outer midsole surface 204 as well as midsole sidewall surface 206.

In different embodiments, the geometry of midsole member 200 could vary. Generally, midsole member 200 may have a geometry corresponding to the shape of a foot sole. Moreover, in some embodiments, midsole member 200 could have an approximately constant thickness. In other embodiments, the thickness of midsole member 200 could be variable. For example, in the exemplary embodiment depicted in FIG. 3, midsole member 200 has a first thickness T1 at forefoot portion 10, and a second thickness T2 at heel portion 14. Further, thickness T2 is significantly smaller than thickness T1. This configuration provides a recessed lower heel portion 213 for midsole member 200. Specifically, in some cases, recessed lower heel portion 213 is adapted to fit cushioning device 230.

In different embodiments, the relative thicknesses of midsole member 200 and outsole member 220 could vary. In the exemplary embodiment of FIG. 3, outsole member 220 may have an approximately constant thickness T5. In some embodiments, midsole member 200 may generally be thicker than outsole member 220. For example, in some cases, both thickness T1 at forefoot portion of midsole member 200 and thickness T2 at heel portion 14 of midsole member 200 could be greater than thickness T5 of outsole member 220. Alternatively, in other cases, thickness T1 could be greater than thickness T5, but thickness T2 may not be greater than thickness T5. In other embodiments, midsole member 200 could be similar in thickness to outsole member 220. For purposes of illustration, some schematic cross-sectional views of the figures show midsole member 200 and outsole member 220 as having similar thicknesses, though in at least some embodiments midsole member 200 may be substantially thicker than outsole member 220.

Some embodiments of midsole member 200 may include an opening 209 associated with heel portion 14 of midsole member 200. In some embodiments, opening 209 provides visibility of cushioning device 230 on inner midsole surface 202 when cushioning device 230 is assembled with midsole member 200. In at least some embodiments, the void of midsole material provided by opening 209 may allow the heel of the foot to interact with cushioning device 230 in a more direct manner. This may improve the response of, and energy return provided by, cushioning device 230.

Figure 4:
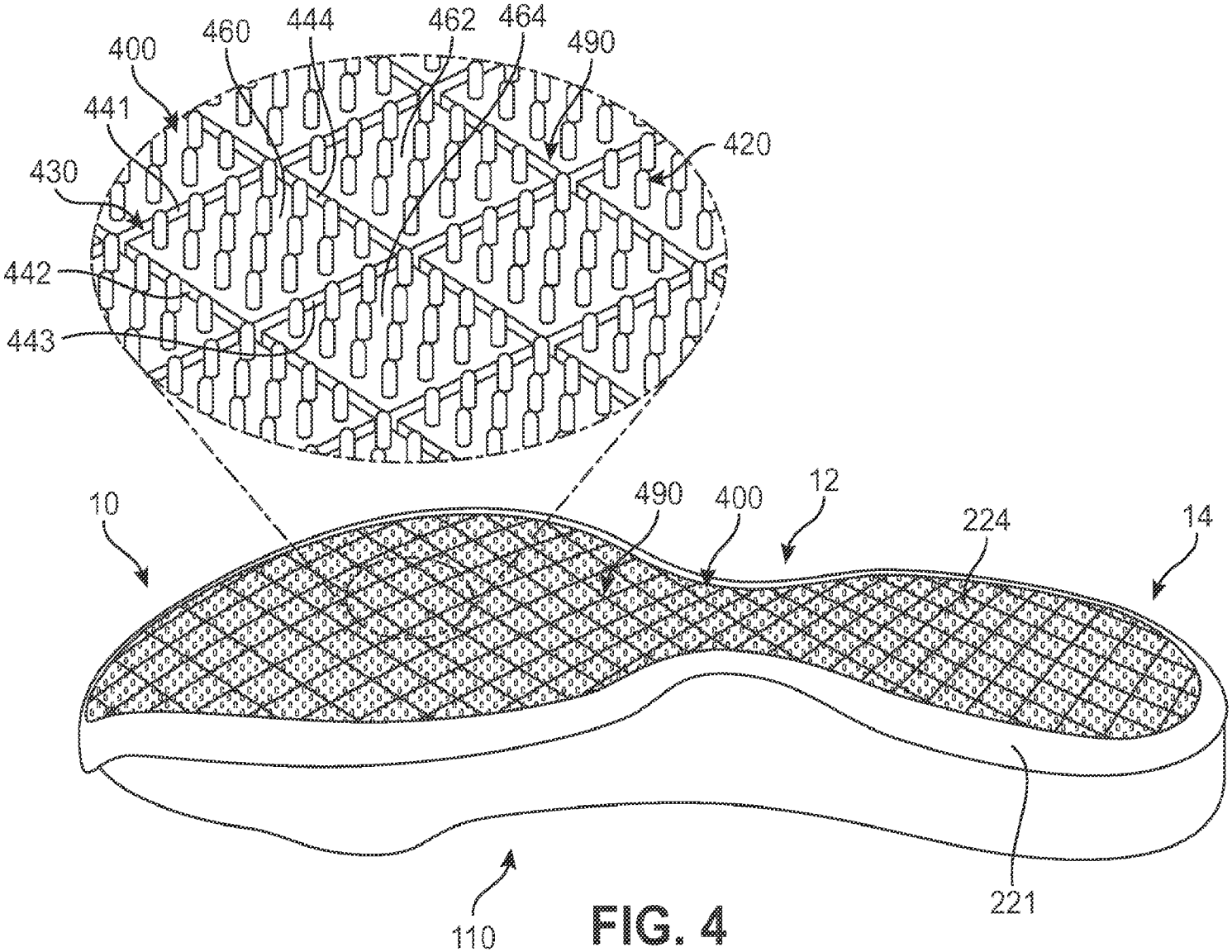
FIG. 4 is an isometric view of an embodiment of an outer side of a sole structure, where the sole structure includes a plurality of bristle members.

Outsole member 220 may include an inner outsole surface 222 and an outer outsole surface 224 (see FIG. 4). In the exemplary embodiment, inner outsole surface 222 may be disposed proximally (i.e., closer to) an interior cavity of upper 102 than outer outsole surface 224. In some embodiments, inner outsole surface 222 may be directly disposed against or near outer midsole surface 204. In other embodiments, inner outsole surface 222 may be disposed against or near portions of exterior support member 210. For example, in some embodiments, exterior support member 210 could include a lower layer or lip (not shown in FIG. 3) that may contact inner outsole surface 222.

Outer outsole surface 224, which is shown in FIG. 4 and described in further detail below, may generally be a ground contacting surface. In particular, in some embodiments, outer outsole surface 224 may include provisions for increasing traction with a ground surface. Also, in some embodiments, outer outsole surface 224 may be configured to be wear resistant, such that outer outsole surface 224 provides improved durability to article 100.

In some embodiments, outsole member 220 may also have a geometry corresponding to the sole of a foot. In at least some cases, as best shown in FIG. 4, outsole member 220 may include a peripheral portion 221 that wraps at least partially around the sides of midsole assembly 240.

Exterior support member 210 may be configured to extend around the exterior of at least some portions of midsole member 200. In the exemplary embodiment depicted in FIG. 3, exterior support member 210 includes a sidewall portion 212 that extends around outer perimeter portion 208 of midsole member 200. More specifically, sidewall portion 212 of exterior support member 210 may extend around midsole sidewall surface 206. As shown in FIG. 3, sidewall portion 212 includes an inner sidewall surface 214, which may be disposed against midsole sidewall surface 206, and an outer sidewall surface 216, which may provide an outer sidewall surface for midsole assembly 240, as well as sole structure 110 more generally.

As shown in FIG. 2, in at least some embodiments, sidewall portion 212 of exterior support member 210 extends vertically higher than inner midsole surface 202 when midsole member 200 is assembled with exterior support member 210. This raised sidewall portion 215 of sidewall portion 212 may extend up around a lower periphery 107 of upper 102 (see FIGS. 1-2). In particular, raised sidewall portion 215 may extend in the vertical direction (perpendicular to the longitudinal and lateral directions) so that raised sidewall portion 215 is higher than inner midsole surface 202.

Some embodiments may include features to increase stiffness in one or more portions of sole structure 110. For example, in some embodiments, sole structure 110 may include a reinforcing member 250. In this exemplary embodiment, reinforcing member 250 is disposed in forefoot portion 10. However, in other embodiments, reinforcing member 250 could be disposed in any other portion of sole structure 110. In some cases, reinforcing member 250 may extend on both lateral side 16 and medial side 18. In other embodiments, reinforcing member 250 may be disposed on only lateral side 16. In still other embodiments, reinforcing member 250 may be disposed only on medial side 18.

In some embodiments, reinforcing member 250 may be disposed in exterior support member 210. In the exemplary embodiment, reinforcing member 250 may be substantially stiffer than exterior support member 210. This configuration may increase the stiffness or rigidity of exterior support member 210 at forefoot portion 10, and specifically on lateral side 16 near the toes. This increased support and stiffness may enhance cutting and/or breaking motions where a large amount of force is applied to lateral side 16 in forefoot portion 10.

In different embodiments, the materials used for reinforcing member 250 could vary. Exemplary materials include, but are not limited to: composite materials (e.g., carbon fiber composites, glass fiber composites as well as other composite materials), plastics, as well as other materials.

Cushioning device 230 may include an inner device surface 231 that is disposed against outer midsole surface 204. Cushioning device 230 may also include an outer device surface 232 that is disposed against inner outsole surface 222 and/or against a lower or lip portion (not shown) of exterior support member 210.

Cushioning device 230 may be any kind of device known in the art. Examples of possible cushioning devices that could be used include, but are not limited to: bladders, foam structures, devices incorporating springs as well as other kinds of cushioning devices. In one embodiment, cushioning device 230 may comprise a bladder filled with air or another kind of fluid. Specifically, cushioning device 230 may comprise an outer material layer that encloses a sealed interior chamber.

Each of the components of sole structure 110 may vary in one or material properties or physical characteristics. In some embodiments, each member or component could be characterized by a rigidity or stiffness, which is the extent to which an object resists deformation. For example, midsole member 200 may have a first stiffness, exterior support member 210 may have a second stiffness and outsole member 220 may have a third stiffness. In at least some embodiments, the second stiffness of exterior support member 210 may be greater than the first stiffness of midsole member 200. Also, in some embodiments, the second stiffness of exterior support member 210 may be greater than the third stiffness of outsole member 220. With such a configuration midsole member 200 and outsole member 220 may be configured to bend, stretch, flex or otherwise deform more easily than exterior support member 210. In particular, this arrangement could allow for midsole member 200 and outsole member 220 to react dynamically to various ground contacting forces while exterior support member 210 provides improved strength and support along the perimeter sidewalls of sole structure 110. Of course, in other embodiments the relative stiffness of each component could vary in any desired manner.

Each component may be characterized by varying degrees of stiffness. In some cases, the stiffness of each component may be characterized by a Young's modulus, which is a known measure of stiffness. In one exemplary configuration each component may have a Young's modulus approximately in the range between 0 and 10 GPa. More specifically, in some cases, the Young's modulus of exterior support member 210 may be at least twice as great as the Young's modulus of midsole member 200. In still further cases, exterior support member 210 could have a Young's modulus that is at least 10 times as great as the Young's modulus of midsole member 200.

In different embodiments, the materials used to make components of sole structure 110 could vary. In some embodiments, materials for each component can be selected to achieve desired material properties or physical characteristics, such as a desired rigidity or stiffness for each component. Exemplary materials for midsole member 200 include, but are not limited to: hard and soft foams, plastics, fabrics as well as possibly other kinds of materials. Exemplary materials for outsole member 220 include, but are not limited to: plastic materials, rubber materials and/or fabric materials, as well as possibly other materials. Exemplary materials for exterior support member 210 include, but are not limited to: plastic materials, including relatively flexible plastic materials or relatively rigid plastic materials, composite materials such as carbon fiber composites, glass fiber composites, as well as possibly other materials. In one exemplary embodiment, midsole member 200 may be made of a flexible foam material, outsole member 220 may be made of a flexible and durable plastic material and exterior support member 210 may be made of a relatively rigid plastic material.

Embodiments can include provisions to improve flexibility in one or more components of sole structure 110. In some embodiments, midsole member 200 and outsole member 220 may both be configured with provisions to improve flexibility. In some embodiments, midsole member 200 and outsole member 220 may both be provided with one or more grooves that improve flexibility by providing a predefined location for bending, compression and/or stretching.

The term "groove" as used throughout this detailed description and in the claims refers to a cut or depression in a surface (e.g., a midsole surface or an outsole surface). As used herein, a groove does not extend through the entirety of a structure, i.e., from one surface to an opposing surface. In particular, each groove of the exemplary embodiments includes side portions as well as a bottom portion. The bottom portion may be recessed from a first surface of a component, and may also be spaced apart from an opposing second surface of the component, as discussed in further detail below.

As shown in FIGS. 2-3, midsole member 200 may include a plurality of midsole grooves 260. Plurality of midsole grooves 260 may extend through inner midsole surface 202 in forefoot portion 10. In the exemplary embodiment, it may also be seen that none of the grooves in plurality of midsole grooves 260 extends all the way to outer peripheral region 270 of midsole member 200, which is associated with the intersection of inner midsole surface 202 and midsole sidewall surface 206. Instead, each of the grooves in plurality of midsole grooves 260 is disposed within central region 271, which is bounded (i.e., disposed inwardly of) outer peripheral region 270. For example, a first midsole groove 280 has a first end 281 and a second end 282 disposed in central region 271 (i.e., inwards of outer peripheral region 270) Likewise, a second midsole groove 284, which intersects first groove 280, has a first end 285 and a second end 286 disposed in central region 271.

This configuration allows for improved flexibility in central region 271 of forefoot portion 10, which may be important to facilitate multi-directional bending in forefoot portion 10. Of course, in other embodiments, plurality of midsole grooves 260 could extend into other portions of midsole member 200. For example, in another embodiment, plurality of midsole grooves 260 could extend through midfoot portion 12 of midsole member 200. In still another embodiment, plurality of midsole grooves 260 could extend through heel portion 14 of midsole member 200.

Generally, plurality of midsole grooves 260 may be configured in any arrangement or pattern on midsole member 200. In some embodiments, two or more grooves may intersect. In other embodiments, two or more grooves may be approximately parallel to one another. In the exemplary embodiment shown in FIGS. 2-3, plurality of midsole grooves 260 may be arranged into a grid 290. The specific configuration of plurality of midsole grooves 260 into grid 290 is discussed in further detail below and shown in FIG. 8.

FIG. 4 is a bottom perspective view of sole structure 110 in which outer outsole surface 224 is clearly visible. Referring to FIG. 4, outsole member 220 may include a plurality outsole grooves 400. Plurality of outsole grooves 400 may extend through outer outsole surface 224.

Generally, plurality of outsole grooves 400 could extend through any portions of outsole member 220. In some embodiments, plurality of outsole grooves 400 could extend through only forefoot portion 10. In still other embodiments, plurality of outsole grooves 400 could extend through only midfoot portion 12. In still other embodiments, plurality of outsole grooves 400 could extend through only heel portion 14. In still further embodiments, plurality of outsole grooves 400 could extend through any combination of forefoot portion 10, midfoot portion 12 and/or heel portion 14. In an exemplary embodiment, plurality of outsole grooves may extend through forefoot portion 10, midfoot portion 12 and heel portion 14.

Generally, plurality of outsole grooves 400 may be configured in arrangement or pattern on outsole member 220. In some embodiments, two or more grooves may intersect. In other embodiments, two or more grooves may be approximately parallel to one another. In the exemplary embodiment shown in FIG. 4, plurality of outsole grooves 400 may be arranged into a grid 490. The specific configuration of plurality of outsole grooves 400 into grid 490 is discussed in further detail below and shown in FIG. 8.

Figure 5:
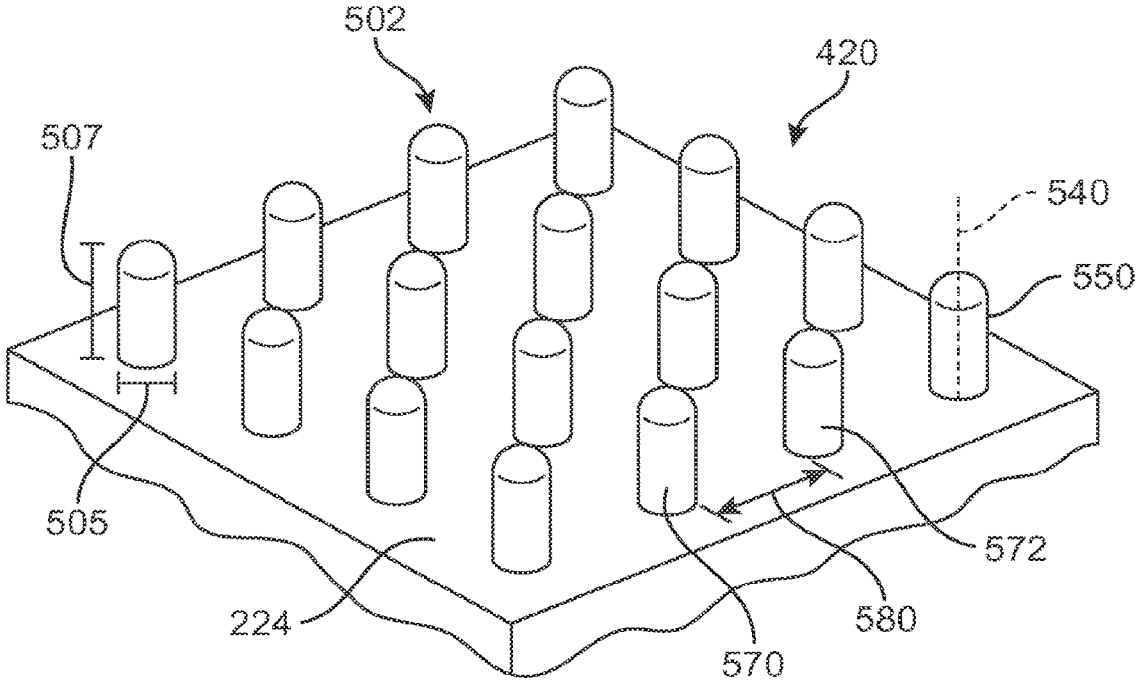
FIG. 5 is an isometric view of an embodiment of a set of bristle members on an outsole member.

Embodiments may include provisions to enhance traction on outer outsole surface 224 of sole structure 110. In some embodiments, outsole member 220 may be configured with various traction elements, treads and/or regions having substantially high coefficients of friction with a ground surface. In the exemplary embodiment depicted in FIG. 4, outsole member 220 may comprise a plurality of bristle members 420. Specifically, in the exemplary embodiment, plurality of bristle members 420 project from outer outsole surface 224 of outsole member 220 in order to enhance traction with a ground surface. FIG. 5 illustrates an enlarged view of a set of bristle members 502 that may be part of plurality of bristle members 420. For purposes of clarity, set of bristle members 502 is shown in isolation from the remaining portions of outsole member 220 and sole structure 110.

Referring to FIGS. 4-5, each bristle member may be configured with a relatively small size. For example, in some embodiments, the diameter of each bristle member, indicated in FIG. 5 as diameter 505, could vary between 0.05 mm and 5 mm. Likewise, the height of each bristle member, indicated in FIG. 5 as height 507, could vary between 0.5 mm and 10 mm. Moreover, in some embodiments, the ratio of height 507 to diameter 505 may vary in the range between 0.1 and 1. In some embodiments, plurality of bristle members 420 may be characterized as "micro-bristles".

In different embodiments, the geometry of each bristle member could vary. In some embodiments, each bristle member could have a substantially cylindrical geometry. In some cases, each bristle may be characterized as rod-like, with a diameter that is substantially less than the height of the bristle. Moreover, the cross-sectional geometry of each bristle could vary. Examples of possible cross-sectional geometries include, but are not limited to: rounded geometries, triangular geometries, rectangular geometries, polygonal geometries, regular geometries and irregular geometries. In an exemplary embodiment, each bristle of plurality of bristles members 420 may have an approximately rod-like geometry, which may have an approximately circular cross-sectional shape so that the bristle member can bend when ground contact forces are applied.

In different embodiments the density of bristle members in a particular region of outsole member 220 could vary. In some embodiments, the density could be approximately constant. In other embodiments, the density could vary from one region to another. For example, in some alternative embodiments (not shown), bristle members may be applied in higher densities at a forefoot portion and heel portion of a sole structure than at a midfoot portion of a sole structure. In the exemplary embodiment shown in FIGS. 4-5, plurality of bristle members may generally have a uniform density throughout forefoot portion 10, midfoot portion 12 and heel portion 14 of outsole member 220. This configuration may facilitate approximately uniform levels of traction over these portions of outsole member 220.

The exemplary configuration shows that plurality of bristle members 420 are arranged in sets of 16 bristles, comprised of 4 rows of 4 bristles evenly arranged in a square pattern. Moreover, as clearly shown in the enlarged view of FIG. 4, each set of bristles is arranged in a square bounded by four adjacent grooves. For example, set of grooves 430 is configured in a square on outsole member 220 that is bounded by a first outsole groove 441, a second outsole groove 442, a third outsole groove 443 and a fourth outsole groove 444. This arrangement may enhance traction while minimizing interference between plurality of bristle members 420 and plurality of outsole grooves 400. Moreover, the regular arrangement and distribution of bristle members throughout outsole member 220 may help provide consistent traction throughout outsole member 220.

The exemplary configuration shown in FIG. 4 includes sets of bristle members that are arranged in traction regions of outer outsole surface 224. These individual traction regions are bounded by adjacent pairs of intersecting grooves. In FIG. 4, plurality of bristle members 420 are disposed on traction region 460. Moreover, traction region 460 may be separated from adjacent traction region 462 (by fourth outsole groove 444) and from adjacent traction region 464 (by third outsole groove 443), for example. These individual traction regions may be configured to bend independently of one another, thereby allowing some traction regions to remain in full contact with a ground surface, even as other traction regions are bent away from the surface during cutting or other dynamics motions.

Bristle members may be configured to undergo elastic deformation or elastic bending as outsole member 220 contacts a ground surface. In order to illustrate this elastic deformation, FIG. 5 shows a set of bristle members 502 in a default configuration where no external forces are applied, while FIG. 6 shows the set of bristle members 502 undergoing elastic deformation in response to external forces 600 (e.g., a force applied to outsole member 220 by a ground surface).

Figure 6:
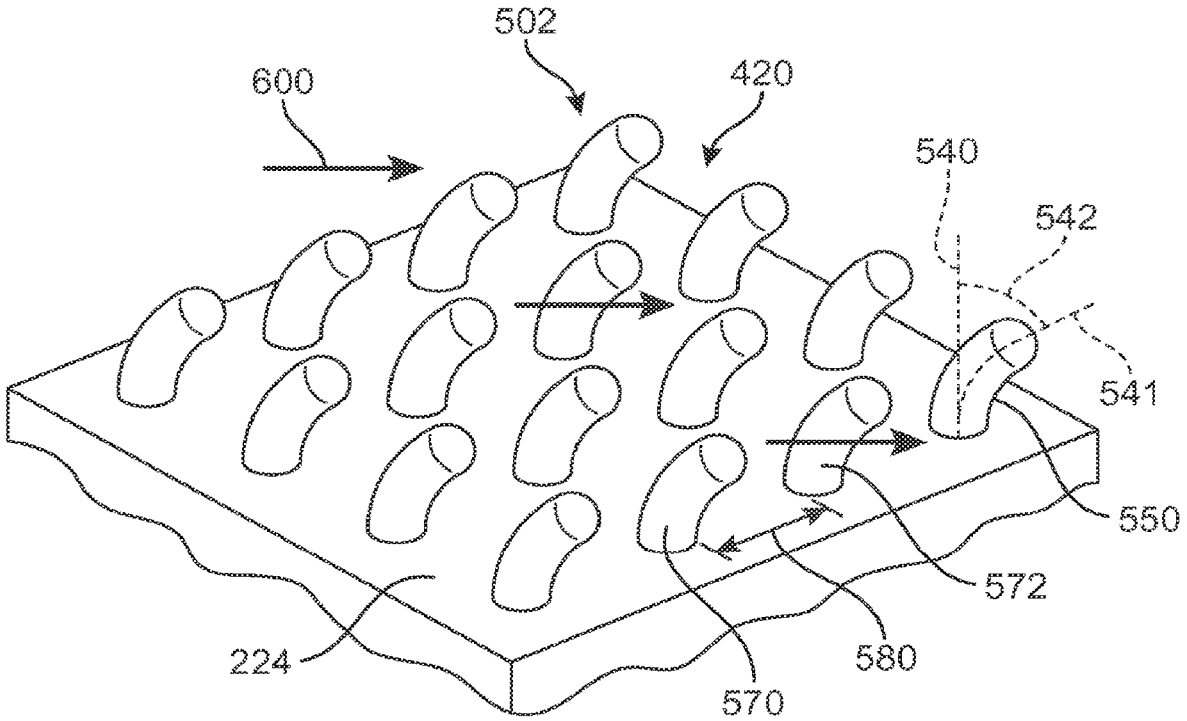
FIG. 6 is an isometric view of the bristle members of FIG. 5 deforming under an applied force.

Referring to FIGS. 5 and 6, in the absence of external forces each bristle member may generally extend in a direction normal to outer outsole surface 224. In FIGS. 5 and 6, a normal direction 540 is indicated schematically, and is seen to generally extend normally (i.e., perpendicularly to) outer outsole surface 224. Moreover, for purposes of illustration, normal direction 540 is aligned with a central axis of a particular bristle member 550. Thus it is clear that bristle member 550 extends in the normal direction 540 when no external forces have been applied to bristle member 550. It will be understood that normal direction 540 is also parallel with the central axes of the other bristle members of set of bristle members 502 so that each bristle member is also seen to extend in the normal direction 540 in the absence of external forces.

As external forces 600 are applied to set of bristle members 502, each bristle member may tend to bend away from the normal direction 540. Thus, for example, a central axis 541 of bristle member 550 is seen to bend at an angle 542 with respect to normal direction 540. Each of the other bristle members are also seen to deform in a similar manner. Once external forces 600 are removed, each bristle member of set of bristle members 502 may return to the configuration shown in FIG. 5, with each bristle member aligned along the normal direction 540.

Generally, the spacing between adjacent bristle members could vary. In some embodiments, the spacing could be small relative to, for example, the height and/or diameter of a bristle member. In other embodiments, the spacing could be large relative to the height and/or diameter of a bristle member. In the exemplary embodiment shown in FIGS. 5 and 6, each bristle member may be physically spaced apart by a spacing 580. Specifically, a bristle member 570 and a bristle member 572 of set of bristle members 502 are spaced apart by spacing 580. In some embodiments, spacing 580 may be selected to allow for substantial bending of adjacent bristle members under applied forces. In particular, spacing 580 may be selected so that adjacent bristle members 502 do not easily interact, even in the case where only one of the bristles is undergoing bending. This spacing may be characterized relative to other dimensions of the bristle member, such as the diameter and/or height. In some embodiments, for example, spacing 580 may be greater than diameter 505. Moreover, in some cases, spacing 580 may be between 0.5 and 1.5 times height 507. This relative size of spacing 580 to diameter 505 and/or height 507 may decrease the tendency of adjacent bristle members to contact one another, since such contact could limit the motion of the bristle members and decrease their tendency to bend and drag against a ground surface.

Figure 7:
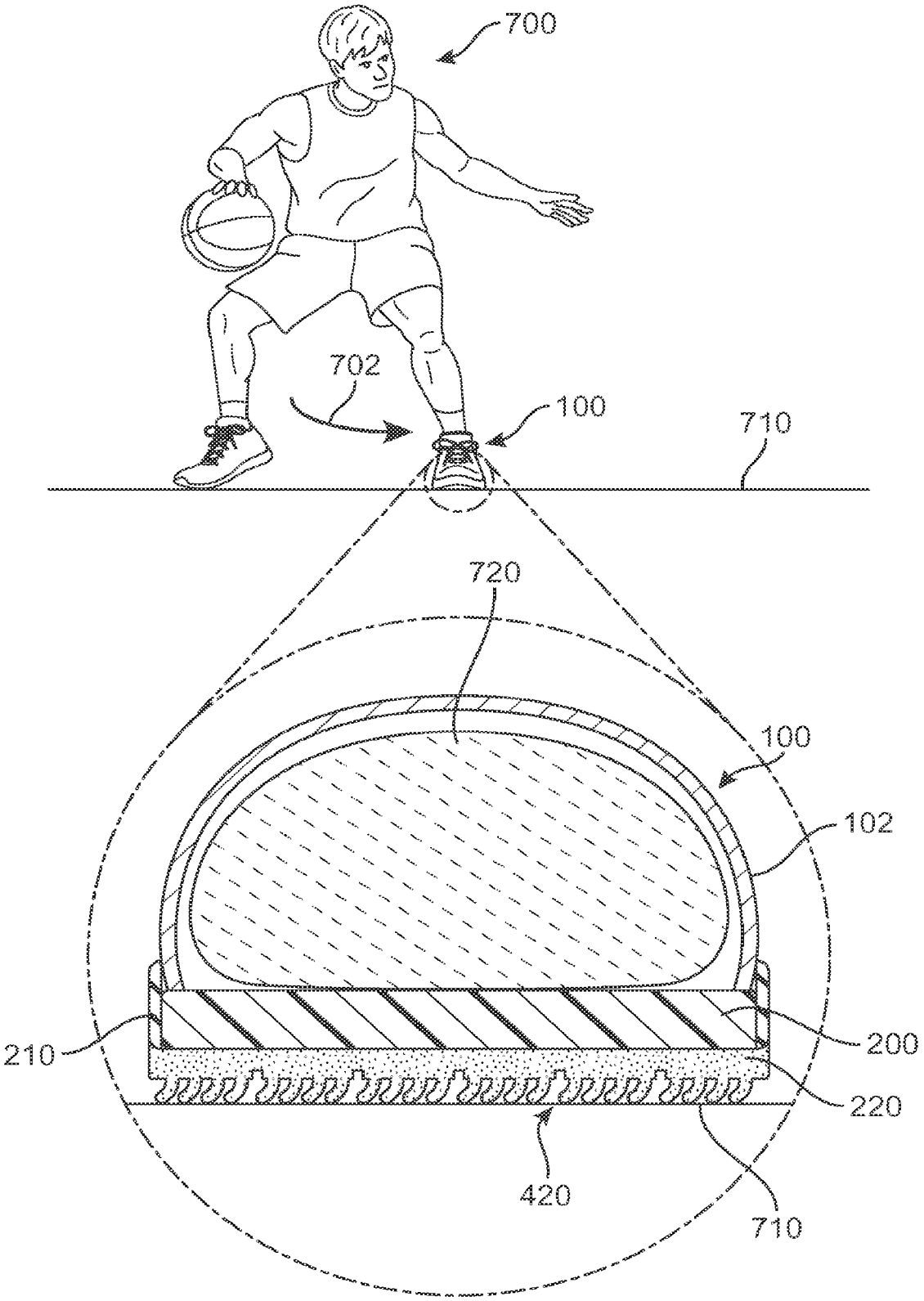
FIG. 7 is a schematic view of a user moving on a ground surface while wearing an article of footwear, including an enlarged cross-sectional view of the article of footwear according to an embodiment.

FIG. 7 illustrates an exemplary situation where plurality of bristle members 420 may help enhance traction with a ground surface to assist an athlete. In this situation, a basketball player 700 has made a sudden step to his left, as indicated by arrow 702. In order to prevent his foot 720 from sliding at the end of this motion, outsole member 220 may be configured to apply a large amount of traction with ground surface 710 (e.g., the floor of a basketball court). To achieve the large amount of traction, plurality of bristle members 420 may bend as frictional forces are applied by ground surface 710. As plurality of bristle members 420 bend, each bristle member may increase its contact area with ground surface 710, which further increases friction and acts to bring article 100 and foot 720 to a stop.

In different embodiments, the material properties of one or more bristle members could vary. In some embodiments, plurality of bristle members 420 could be made of a substantially similar material to outsole member 220. In other embodiments, however, plurality of bristle members 420 could be made of a different material from outsole member 220. Exemplary materials for plurality of bristle members 420 include any kinds of plastics, rubbers or other materials known in the art for forming outsoles and/or components attached to outsoles (e.g., cleats, tread elements, etc.). In some embodiments, plurality of bristle members 420 may be made of a material that is bond compatible with outsole member 220.

Bristle members could be formed in any manner. In some embodiments, plurality of bristle members 420 may be integrally formed with outsole member 220, for example, during a molding process. In other embodiments, plurality of bristle members 420 could be formed separately from outsole member 220 and attached to outsole member 220.

Although the exemplary embodiment depicts a generally uniform distribution of bristle members, in other embodiments the distribution of bristle members could vary in different regions of an outsole member. In some embodiments, for example, bristle members could be configured with a higher density in a forefoot portion and a lower density in a midfoot and/or heel portion of the outsole member. By varying the distribution of bristle members over the outsole member, the traction properties of the sole structure can be tuned to achieve desired performance characteristics, such as improved traction at particular locations of the outsole member.

Embodiments may include provisions for enhancing flexibility of one or more portions of a sole structure. In some embodiments, both a midsole member and an outsole member may include one or more grooves. Further, in some embodiments, at least some grooves of the midsole member may be associated with at least some grooves of the outsole member. In particular, in some embodiments, some grooves of the midsole member may be approximately aligned with some grooves of the outsole member, thereby increasing the ability of the sole structure to bend at locations where grooves are aligned.

Figure 8:
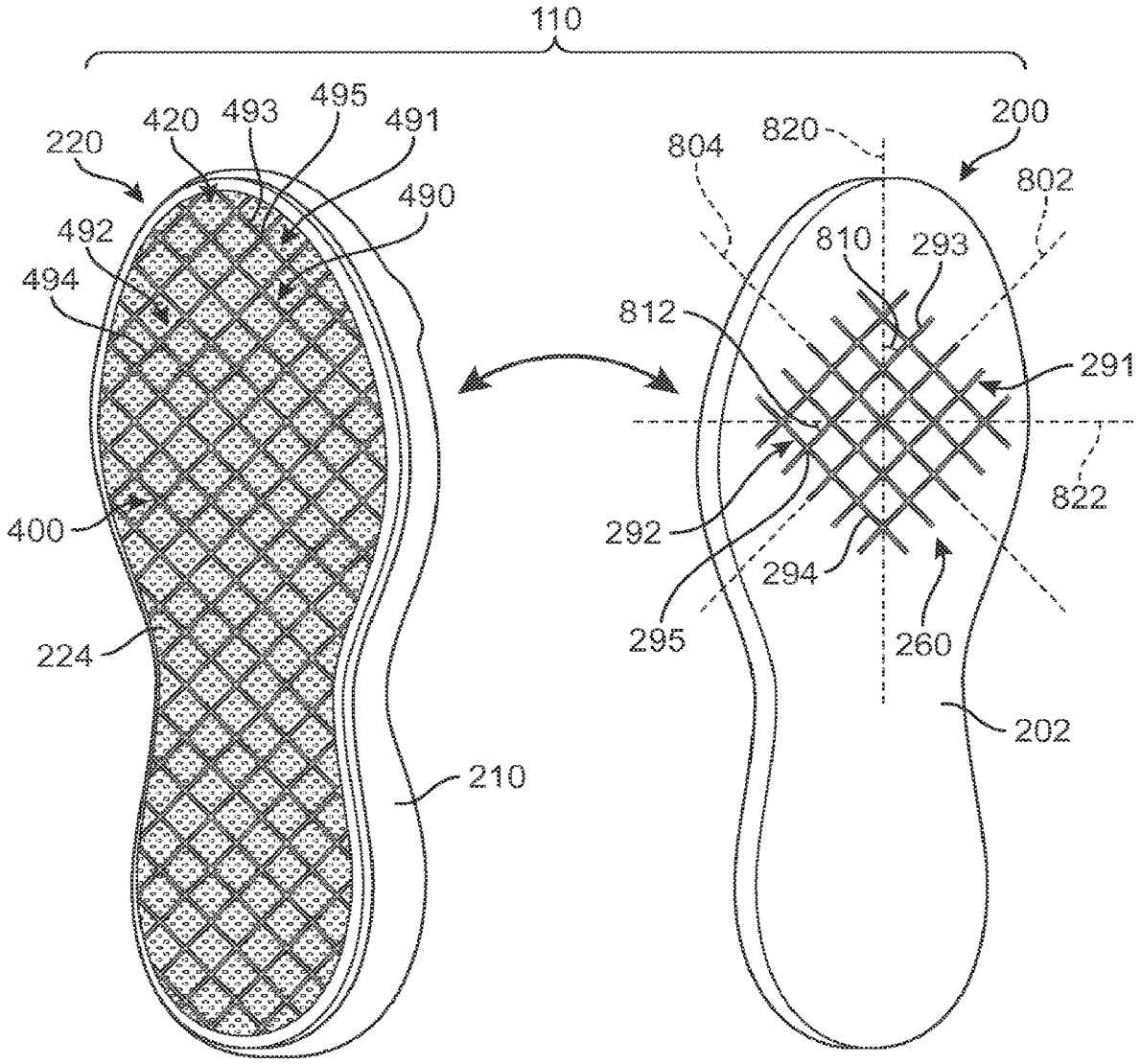
FIG. 8 is an isometric exploded view of an embodiment of a sole structure in which an outer surface of an outsole member and the inner surface of a midsole member are both visible.

FIG. 8 is an exploded view of an embodiment of sole structure 110, in which midsole member 200 has been separated from outsole member 220 and exterior support member 210. As previously discussed, outsole member 220 has a plurality of outsole grooves 400 and midsole member 200 has a plurality of midsole grooves 260. In the exemplary embodiment, plurality of outsole grooves 400 are disposed on outer outsole surface 224, while plurality of midsole grooves 260 are disposed on inner midsole surface 202.

In the exemplary embodiment, grid 290 is comprised of a first set of grooves 291 and a second set of grooves 292. In this case, first set of grooves 291 are oriented in a first direction, which is indicated in FIG. 8 by first directional axis 802, and are approximately parallel to one another. Likewise, second set of grooves 292 are oriented in a second direction, which is indicated in FIG. 8 by second directional axis 804, and are approximately parallel to one another. Moreover, first set of grooves 291 and second set of grooves 292 may generally intersect such that each groove in first set of grooves 291 intersects one or more grooves in second set of grooves 292 at an approximately 90 degree angle. For example, first groove 293 of first set of grooves 291 is seen to intersect second groove 294 of second set of grooves 292 at a groove intersection 295.

In different embodiments, a grid of grooves may be oriented in any way on a midsole member. In some embodiments, a grid could be oriented such that one set of parallel grooves run in a lateral direction, while another set of parallel grooves run in a longitudinal direction. In the exemplary embodiment of FIG. 8, grid 290 is oriented so that the first direction and the second direction are each angled with respect to the longitudinal direction and the lateral direction. Specifically, each groove of grid 290 forms an oblique angle with both the longitudinal direction and the lateral direction. As used herein, the term "oblique angle" refers to any angle that is neither a right angle, or a multiple of a right angle (e.g., an angle different from 0, 90, 180, or 270 degrees). As one particular example, first groove 293 forms an oblique angle 810 with a longitudinal axis 820 and first groove 293 forms an oblique angle 812 with lateral axis 822. Moreover, each of the remaining grooves of plurality of midsole grooves 260 may be seen to intersect longitudinal axis 820 and lateral axis 822 at oblique angles.

Generally, the angle of intersection between two grooves in a grid may vary. In some embodiments, grooves arranged in grids may intersect at an oblique angle. The exemplary embodiment depicts grooves arranged in grids where intersecting grooves form approximately right angles with one another. However, in other embodiments, grooves may be arranged into grid-like patterns where the intersection angles are different from 90 degrees. In such grids, intersecting grooves could form any oblique angles. Moreover, the angles between intersecting grooves could vary throughout the grid, thereby resulting in irregular or distorted grid patterns.

In the exemplary embodiment, plurality of outsole grooves 400 on outsole member 220 may be configured in a similar way to the grooves on midsole member 200. For example, in the exemplary embodiment, plurality of outsole grooves 400 may be configured as grid 490 that is comprised of two sets of grooves, including a first set of outsole grooves 491 and a second set of outsole grooves 492. In this case, first set of outsole grooves 491 are oriented in a direction that is generally perpendicular to the direction of second set of outsole grooves 492. Thus, for example, a first outsole groove 493 of first set of outsole grooves 491 is seen to intersect a second outsole groove 494 of second set of outsole grooves 492 at an approximately 90 degree angle at groove intersection 495. In at least some embodiments, when outsole member 220 is assembled with midsole member 200, first set of outsole grooves 491 may be oriented in the first direction, i.e., along first directional axis 802, while second set of outsole grooves 492 may be oriented in the second direction, i.e., along second directional axis 804.

In different embodiments, a grid of grooves may be oriented in any way on an outsole member. In some embodiments, a grid could be oriented such that one set of parallel grooves run in a lateral direction, while another set of parallel grooves run in a longitudinal direction. In the exemplary embodiment of FIG. 8, grid 490 is oriented so each groove forms an oblique angle with a longitudinal axis and with a lateral axis of sole structure 110.

As shown in FIG. 8, in an exemplary embodiment, at least some of plurality of outsole grooves 400 may be in correspondence with at least some of plurality of midsole grooves 260. In some embodiments, plurality of outsole grooves 400 comprises grid 490, a portion of which may correspond to plurality of midsole grooves 260 that are arranged in grid 290.

The correspondence of grid 290 and grid 490 may be characterized in various ways. As previously mentioned, grid 290 and grid 490 may be oriented in a similar direction, such that the grooves of grid 290 and the grooves of grid 490 each form similar angles with respect to longitudinal axis 820 and lateral axis 822. Still further, in some cases, grid 290 and grid 490 may be arranged so that at least some grooves of grid 290 are aligned with grooves of grid 490.

Figure 9:
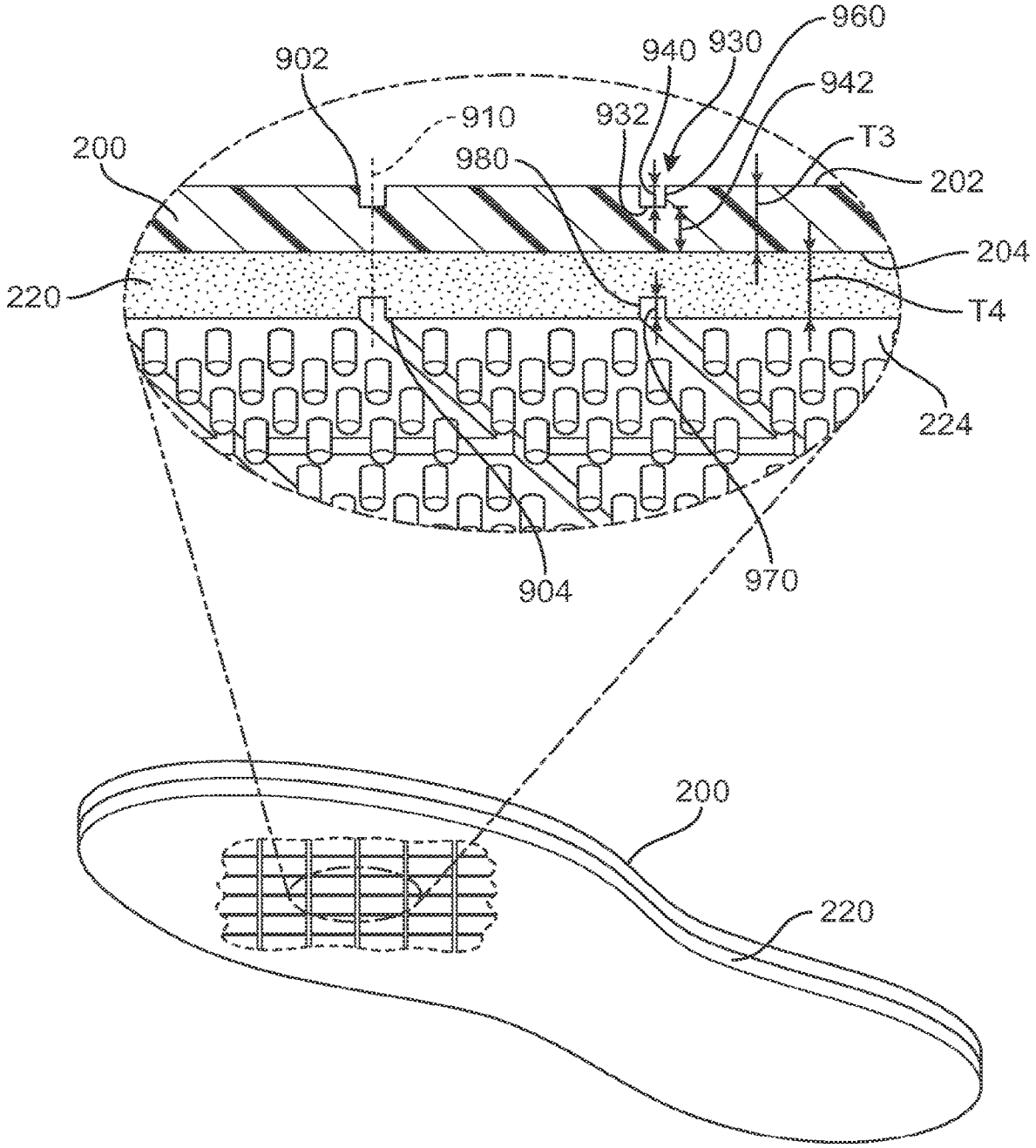
FIG. 9 is a schematic isometric view of an embodiment of an outsole member and a midsole member, including an enlarged cut-away view of the outsole member and the midsole member.

FIG. 9 shows an isometric view of midsole member 200 and outsole member 220 and an enlarged cut-away view of a portion of these members. As depicted in FIG. 9, a groove 902 of grid 290 on midsole member 200 is vertically aligned with a groove 904 of grid 490 on outsole member 220. As used herein, two grooves are said to be "vertically aligned" if a vertical axis extending through sole structure 110 intersects both grooves. For example, groove 902 and groove 904 are vertically aligned since they are both intersected by vertical axis 910. Although FIG. 9 only depicts the vertical alignment of a couple of grooves in midsole member 200 and outsole member 220, it will be understood that in some embodiments any number of grooves of grid 290 could be aligned with grooves in grid 490. In at least one embodiment, each of the grooves in grid 290 may be aligned with a corresponding groove on outsole member 220.

Although the exemplary embodiment depicts grooves on midsole member 200 and outsole member 220 that may have similar orientations and may be vertically aligned, in other embodiments the grooves may not be similarly oriented or vertically aligned. For example, in an alternative embodiment, grid 290 could be rotated with respect to grid 490 such that grooves in grid 290 extend in different horizontal directions (e.g., longitudinal and lateral directions) than the grooves in grid 490. In still another alternative embodiment, grid 290 and grid 490 could have a similar orientation but may not be aligned vertically. Such an arrangement could be achieved by using different grid spacing for grid 290 and grid 490 and/or displacing the centers of grid 290 and grid 490. It will be appreciated that even in embodiments where grid 290 and grid 490 do not coincide, or are not generally aligned in a direction, the use of a separate grid of grooves in midsole member 200 and in outsole member 220 may still enhance bending and flexing for a sole structure.

As best shown in FIG. 9, each groove may not extend through the entirety of a member. For example, groove 930 is recessed by a depth 940 from inner midsole surface 202. In the exemplary embodiment, groove 930 may be comprise sidewall portions 960 and bottom portion 932. Further, the deepest portion of groove 930, bottom portion 932, is spaced apart by a distance 942 from outer midsole surface 204. In particular, it can be seen that depth 940 is substantially less than thickness T3 of a portion of midsole member 200 that is adjacent to groove 930. Moreover, each groove of outsole member 220 may also have a depth that is substantially less than a thickness of outsole member 220. For example, a groove 980 in outsole member 220 is seen to be recessed by a depth 970 from outer outsole surface 224. Depth 970 may be substantially less than thickness T4 of a portion of outsole member 220 adjacent to groove 980.

Figure 10:
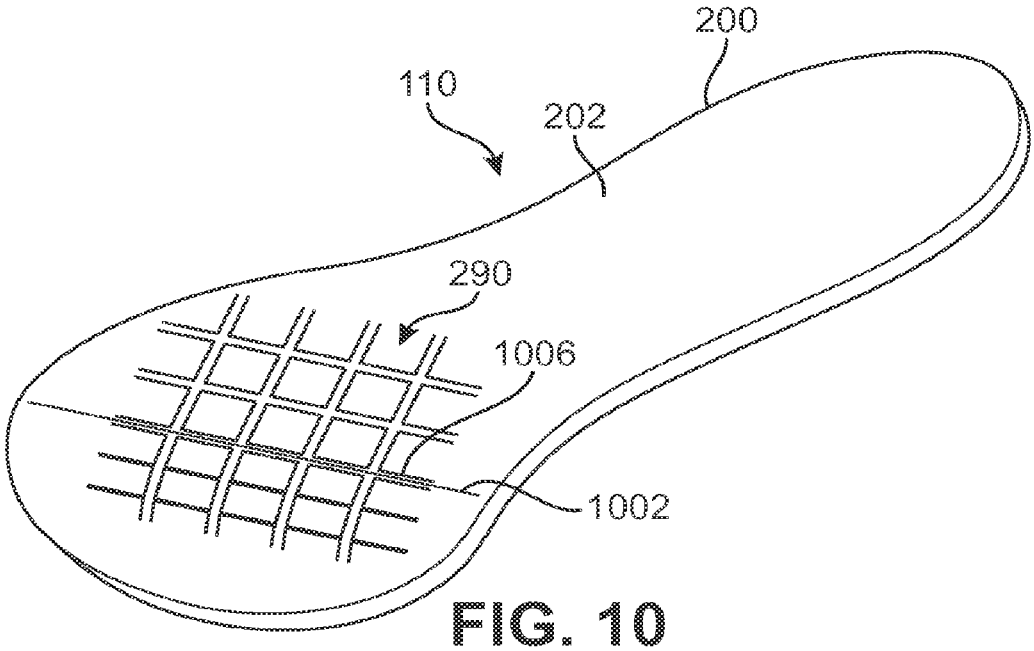
FIG. 10 is a schematic view of an embodiment of a sole structure undergoing bending at a groove in a midsole member.
Figure 11:
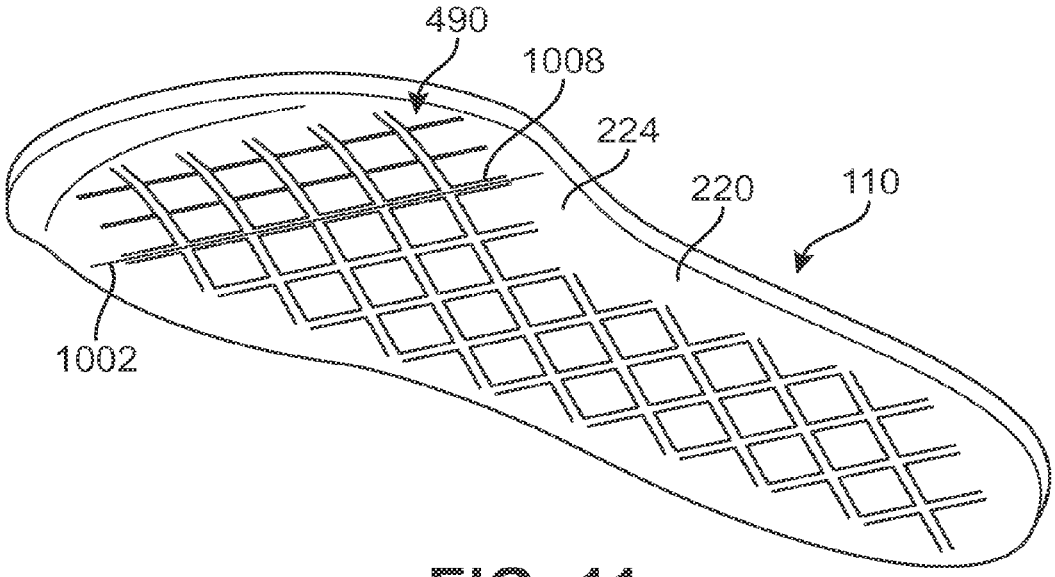
FIG. 11 is a schematic view of the sole structure of FIG. 10 undergoing bending at a groove in an outsole member.
Figure 12:
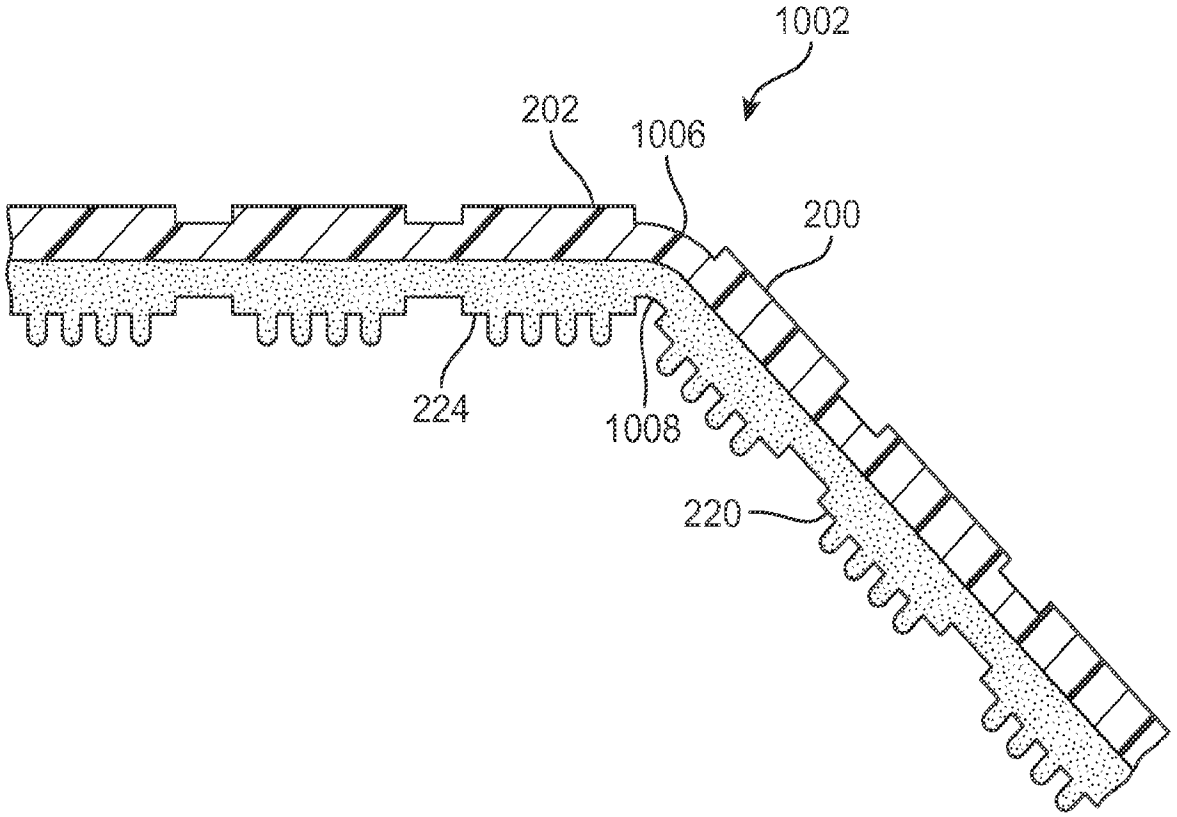
FIG. 12 is a schematic cross-sectional view of an embodiment of a midsole member and an outsole member bending at a pair of corresponding grooves.

FIGS. 10-12 illustrate schematic views of members of a sole structure undergoing bending at a portion associated with grooves. Specifically, FIG. 10 illustrates an isometric view of an embodiment of sole structure 110 in which midsole member 200 is visible, while FIG. 11 illustrates an isometric view of sole structure 110 in which outsole member 220 is visible. FIG. 12 illustrates a schematic cross-sectional view of a portion of midsole member 200 and outsole member 220 undergoing bending. For purposes of clarify, sole structure 110 is shown without exterior support member 210 in FIGS. 10-12.

Referring to FIGS. 10-12, sole structure 110 may bend along a bending axis 1002. In this case, bending axis 1002 occurs along a region where a groove 1006 on inner midsole surface 202 is vertically aligned with groove 1008 on outer outsole surface 224. As clearly shown in FIG. 12, the alignment of groove 1006 and groove 1008 provides a region of substantially reduced thickness of sole structure 110, compared to portions without grooves.

This exemplary configuration enhances bending at locations where grooves in midsole member 200 and outsole member 220 may be approximately aligned. In particular, as seen in FIGS. 10-12, groove 1006 and groove 1008 cooperate to enhance bending through the entire thickness of sole structure 110, rather than just within a single component or layer of sole structure 110.

Embodiments can include provisions to enhance multi-directional bending. Due to the configuration of grooves on midsole member 200 and outsole member 220, sole structure 110 may be configured to undergo multi-directional bending. Specifically, the arrangement of grooves on midsole member 200 and outsole member 220 may be configured to enhance bending around multiple directions of sole structure 110, rather than a single bending direction (e.g., bending forwards or backwards).

FIGS. 13-16 illustrate various schematic views of a player 1300 wearing a pair of articles including article 100. Further, within each of FIGS. 13-15 a schematic isolated view of some components of sole structure 110 are shown to indicate the particular configuration of grooves in the sole structure during various motions. For purposes of illustration, FIGS. 13-16 highlight the configurations of grooves in midsole member 200, however it should be understood that in embodiments where the grooves of outsole member 220 have a similar configuration to, and/or are aligned with, the grooves of midsole member 200, the grooves of outsole member 220 may take on similar configurations to those shown for midsole member 200.

Figure 13:
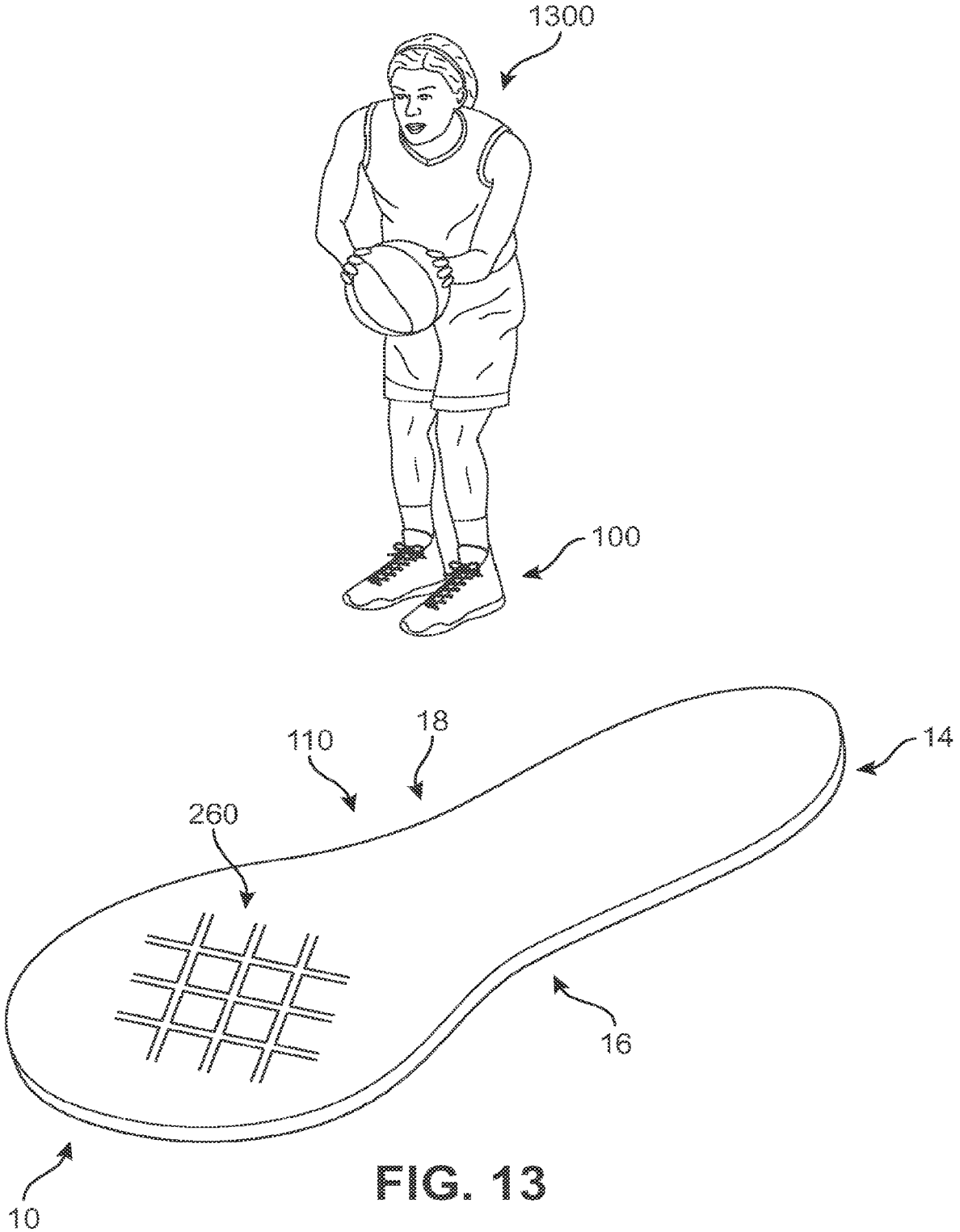
FIG. 13 is a schematic view of a player including an enlarged view of a sole structure in a non-stressed configuration, according to an embodiment.

Referring first to FIG. 13, player 1300 is standing with her feet on the ground. In this stance, player 1300 may be assessing her next move in order to get by or around a possible defender or other player on the court (not shown). In this configuration, plurality of midsole grooves 260 on midsole member 200 are in a non-stressed or non-deformed state.

Figure 14:
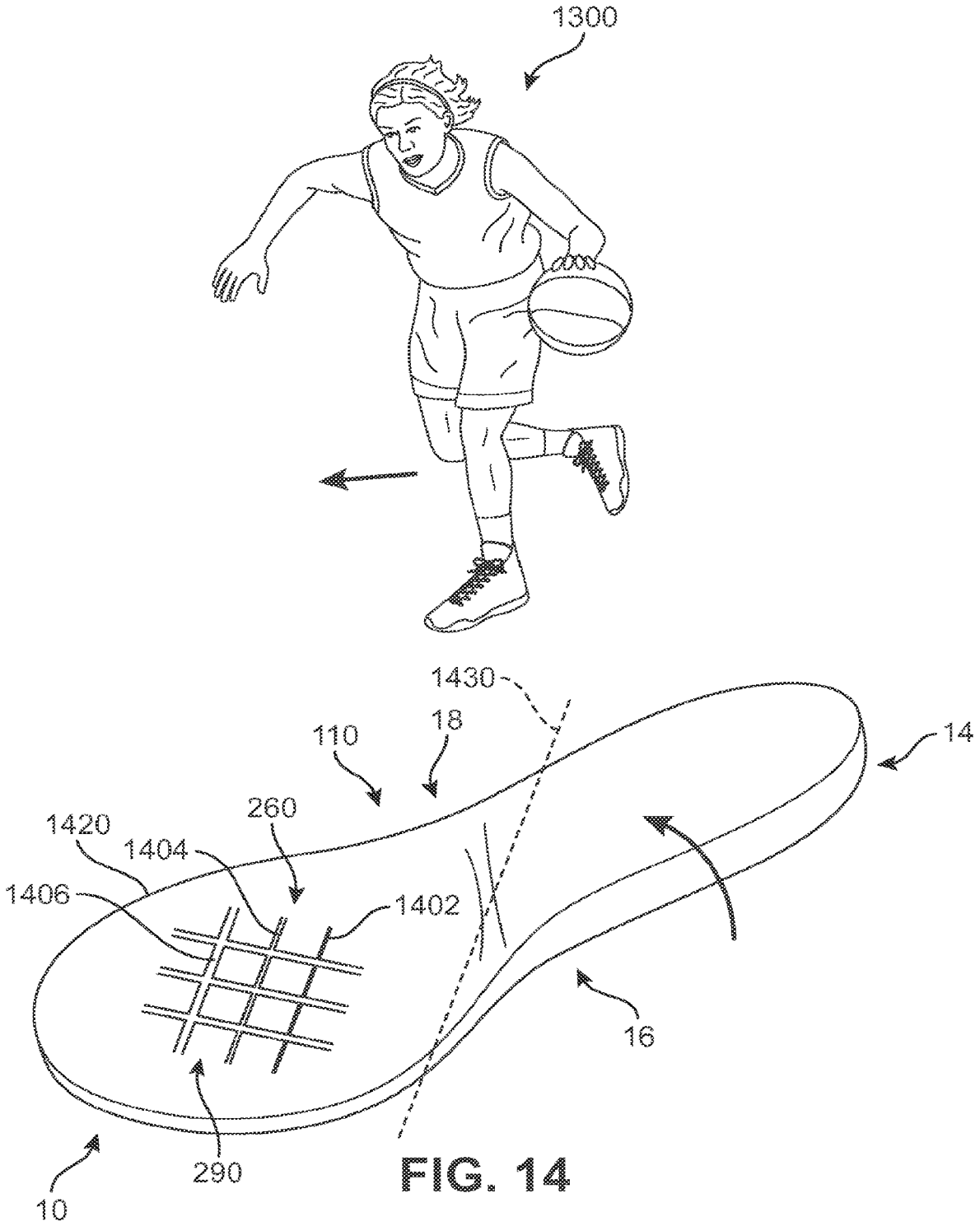
FIG. 14 is a schematic view of the player and the sole structure of FIG. 13, in which the player is moving to her right.
Figure 15:
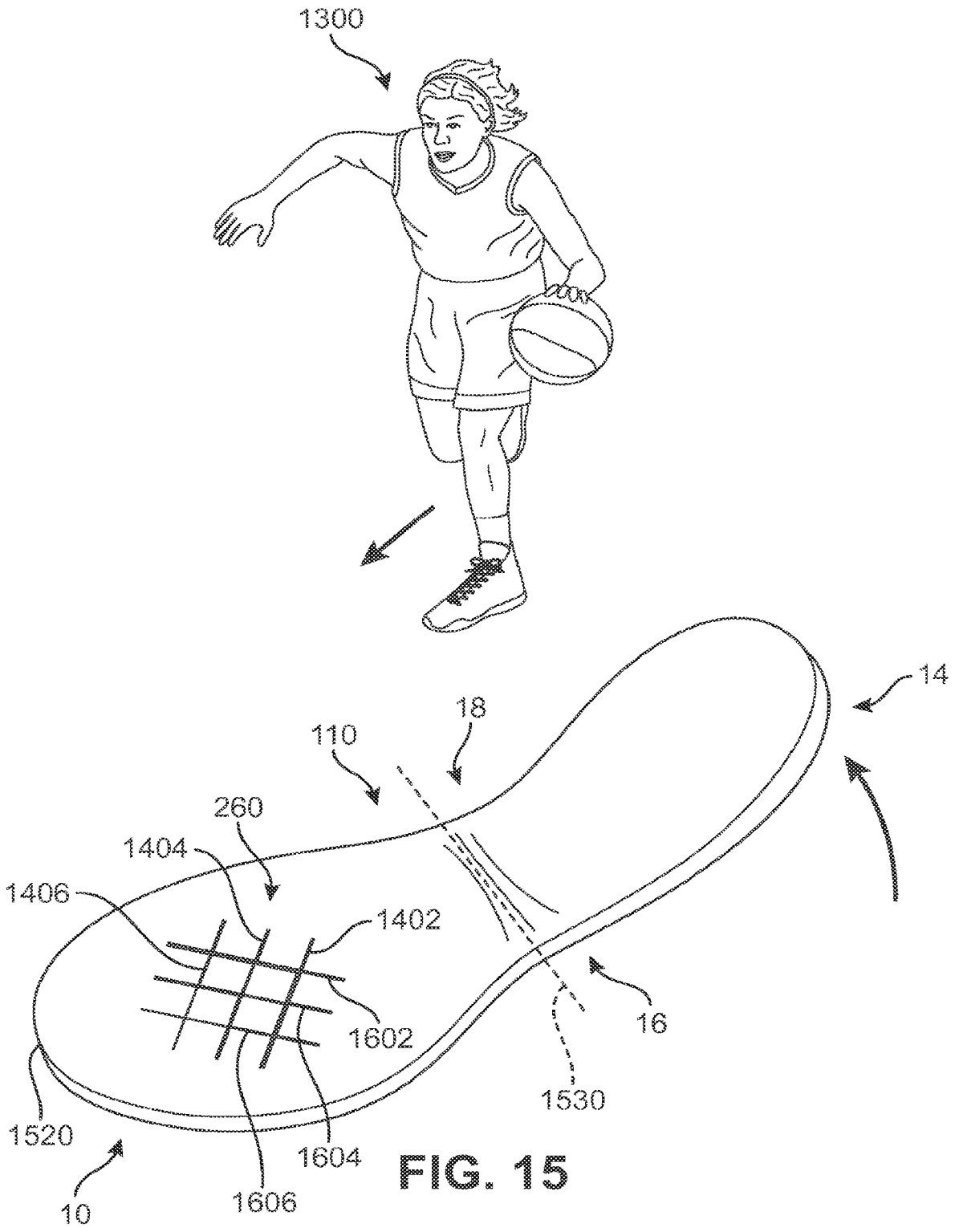
FIG. 15 is a schematic view of the player and the sole structure of FIG. 13, in which the player is moving forward.
Figure 16:
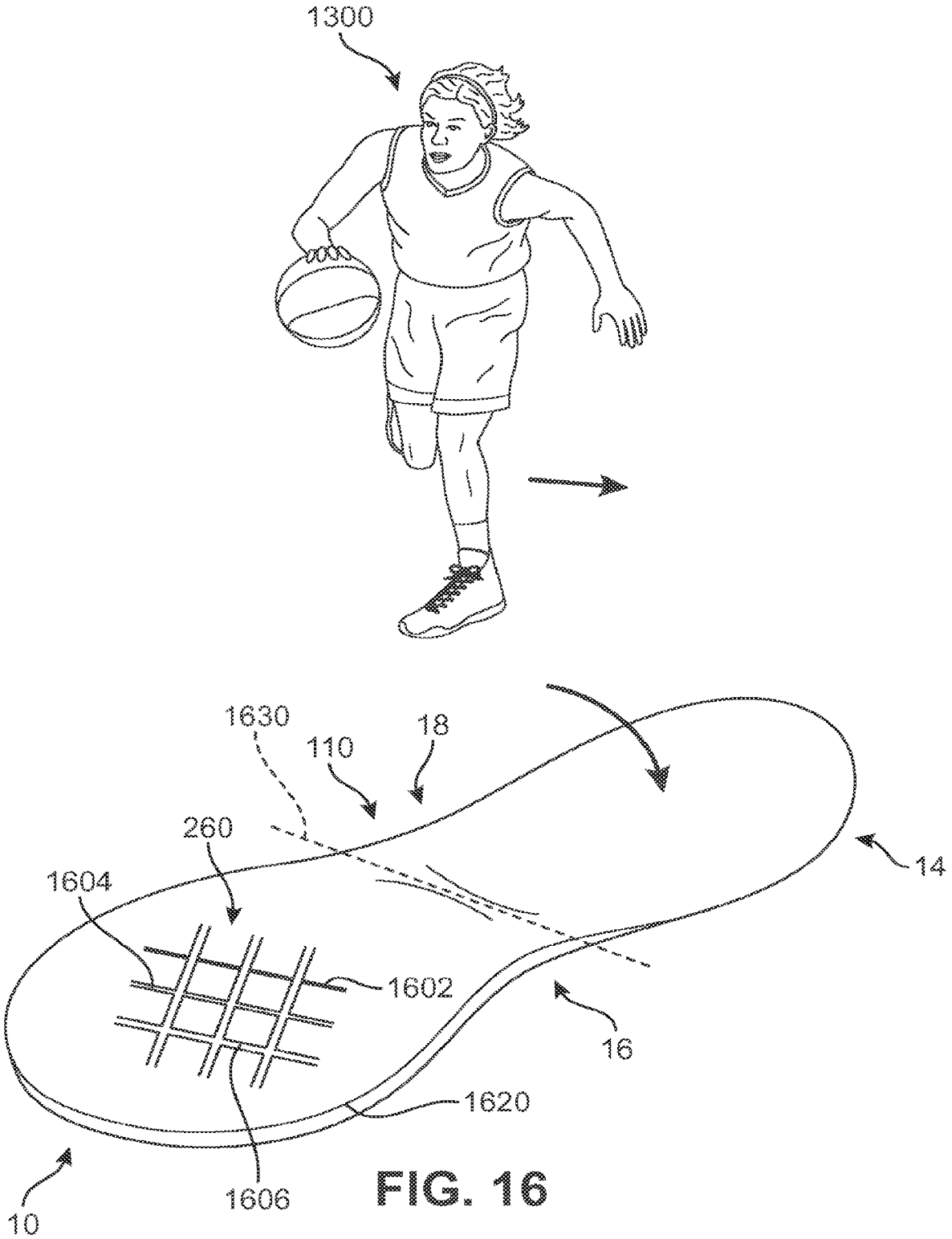
FIG. 16 is a schematic view of the player and the sole structure of FIG. 13, in which the player is moving to her left.

The configuration of grid 290 on midsole member 200 and the corresponding grid 490 on outsole member 220 (not shown) may help provide multi-directional bending for sole structure 110. This arrangement ensures that player 1300 is able to easily move into one of multiple possible directions from the standing position in FIG. 13. For example, FIG. 14 shows a situation where player 1300 has decided to move to her right. FIG. 15 shows a situation where player 1300 has decided to move forwards. FIG. 16 shows a situation where player 1300 has decided to move to her left.

In each of the situations illustrated in FIGS. 14-16, sole structure 110 may bend in a manner that naturally accommodates the type of motion needed to move left, forwards or right. For example, in FIG. 14, as player 1300 moves to her right, heel portion 14 of sole structure 110 is raised while sole structure 110 bends towards a forward medial edge 1420 of sole structure 110. This bending is easily accommodated by grid 290, as midsole member 200 begins to bend at first groove 1402, second groove 1404 and third groove 1406. Here, first groove 1402, second groove 1404 and third groove 1406 are approximately aligned with a natural bending axis 1430 about which sole structure 110 wants to bend to achieve the desired left moving motion. Further, this type of bending is easily accommodated by grid 290, as first groove 1402, second groove 1404 and third groove 1406 are approximately parallel with forward medial edge 1420 of sole structure 110, which is due to the rotational position of grid 290 with respect to the lateral and longitudinal directions.

In the situation illustrated in FIG. 15, as player 1300 moves straight forward, heel portion 14 of sole structure 110 is raised while sole structure 110 bends towards forward-most edge 1520 of sole structure 110. This bending is easily accommodated by grid 290, as midsole member 200 begins to bend at first groove 1402, second groove 1404 and third groove 1406, as well as fourth groove 1602, fifth groove 1604 and sixth groove 1606. Here, each groove is partially bent to allow for bending and contouring of forefoot portion 10 as sole structure 110 bends around the natural bending axis 1530.

In FIG. 16, as player 1300 moves to her left, heel portion 14 of sole structure 110 is raised while sole structure 110 bends towards a forward lateral edge 1620 of sole structure 110. This bending is easily accommodated by grid 290, as midsole member 200 begins to bend at fourth groove 1602, fifth groove 1604 and sixth groove 1606. Here, fourth groove 1602, fifth groove 1604 and sixth groove 1606 are approximately aligned with a natural bending axis 1630 about which sole structure 110 wants to bend to achieve the desired right moving motion. Further, this type of bending is easily accommodated by grid 290, as fourth groove 1602, fifth groove 1604 and sixth groove 1606 are approximately parallel with forward lateral edge 1620 of sole structure 110, which is due to the rotational position of grid 290 with respect to the lateral and longitudinal directions.

Although outsole member 220 is not shown in FIGS. 14-16, it will be understood that grid 490 of grooves on outsole member 220 may generally bend or otherwise behave in a similar manner to the grooves in grid 290 during these various states of motion.

For purposes of clarity, bending in three possible directions for sole structure 110 are shown in FIGS. 14-16. However, the configuration of grooves on midsole member 200 and outsole member 220 provide for bending in many different directions beyond the three exemplary directions shown and described here. In particular, the grid arrangements may allow sole structure 110, especially in forefoot portion 10, to accommodate various kinds of bending and/or contouring. Moreover, the exemplary configuration of grooves in midsole member 200 and outsole member 220 may accommodate bending generally in any direction around forefoot portion 10 (e.g., bending in any of 360 degrees about forefoot portion 10). Thus, this configuration may provide for enhanced multi-directional motion over alternative embodiments that utilize grooves oriented in a single direction (e.g., a single set of parallel grooves).

Figure 18:
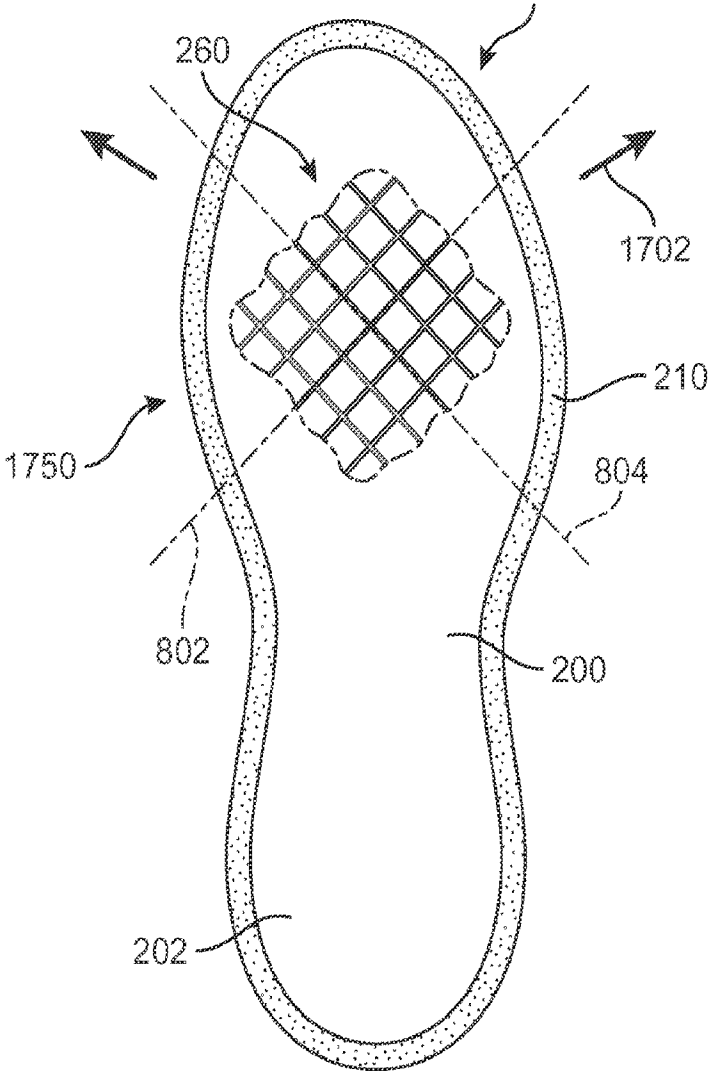
FIG. 18 is a schematic plan view of an embodiment of a sole structure with an exterior support member, in which the sole structure resists horizontal expansion under tension.
Figure 17:
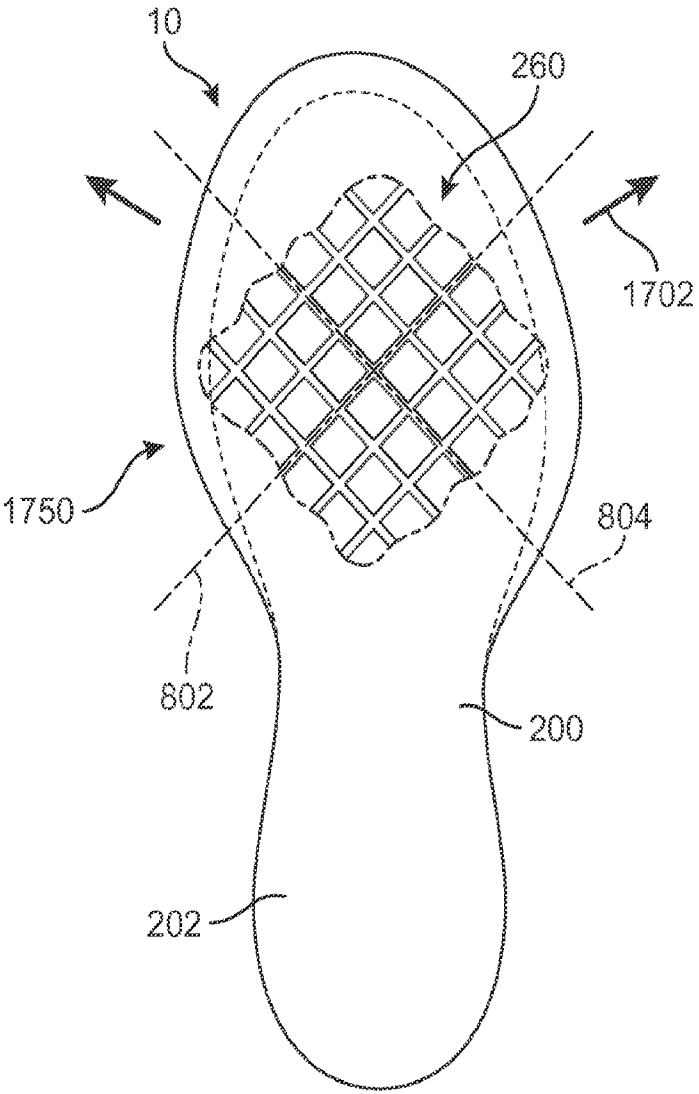
FIG. 17 is a schematic plan view of an embodiment of a sole structure expanding under tension.

Embodiments may include provisions to constrain the horizontal expansion of a sole component with grooves, such as a midsole member or outsole member. FIGS. 17 and 18 illustrate schematic configurations of a midsole member 200. In FIG. 17, midsole member 200 is shown without an exterior support member. In this configuration, as tension 1702 is applied, midsole member 200 may expand horizontally at forefoot portion 10. This may occur because of the tendency of plurality of midsole grooves 260 to expand under tension, due to the reduced midsole material in plurality of midsole grooves 260. In particular, in some cases, the non-groove portions of midsole member 200, which are any portions not including a groove, may be less stiff, or more able to stretch, than the portions with grooves.

As seen in FIG. 18, applying exterior support member 210 may help to constrain the horizontal expansion of midsole member 200 with plurality of midsole grooves 260. In particular, because exterior support member 210 may generally be stiffer than midsole member 200 (as discussed above), exterior support member 210 may resist tension 1702 so that midsole member 200 does not expand in a horizontal direction. By reducing the tendency of midsole member 200 to expand under outward tension, the approximate length and width of sole structure 110, and therefore the fit of article 100, may be maintained throughout use of article 100.

As seen in FIGS. 17 and 18, and as previously discussed, midsole member 200 may have a first direction characterized by a first directional axis 802 and a second direction characterized by a second directional axis 804. The first direction and the second direction may generally define a plane 1750 (see also FIG. 19) that is approximately parallel with inner midsole surface 202. In the configuration shown in FIG. 17, the applied tension 1702 acts to expand midsole member 200 horizontally, such that most of the expansion occurs within plane 1750, defined by the first direction and the second direction. However, as seen in FIG. 18, exterior support member 210 acts to limit horizontal expansion within plane 1750.

Figure 19:
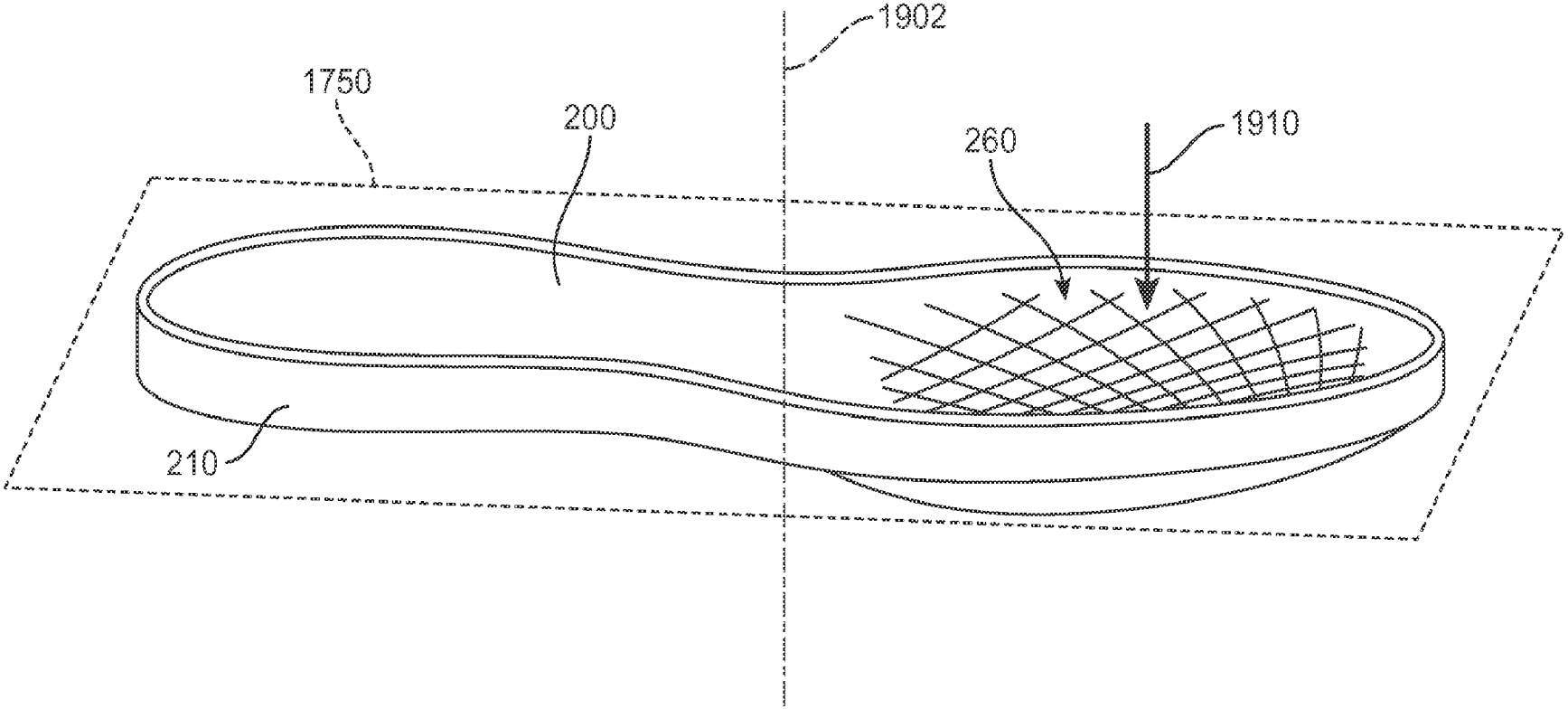
FIG. 19 illustrates a cross-sectional view of an embodiment of a sole structure in which a midsole member expands into a vertical direction.

FIG. 19 illustrates a schematic isometric view of midsole member 200 deforming under an applied force 1910. Referring to FIG. 19, exterior support member 210 may act to limit horizontal expansion of midsole member 200. However, as plurality of midsole grooves 260 of midsole member 200 flex, midsole member 200 may undergo some expansion into a vertical direction characterized by vertical axis 1902. Here, the vertical direction is generally perpendicular to the plane 1750 defined by the surfaces of midsole member 200 when midsole member 200 is in a non-flexed configuration. Plane 1750 is also seen to correspond to the longitudinal and lateral dimensions of exterior support member 210. By restricting horizontal expansion, but allowing for expansion into the vertical direction, exterior support member 210 may accommodate flexing of midsole member 200 while limiting horizontal stretching, as such stretching may be undesirable for some activities.

Figure 20:
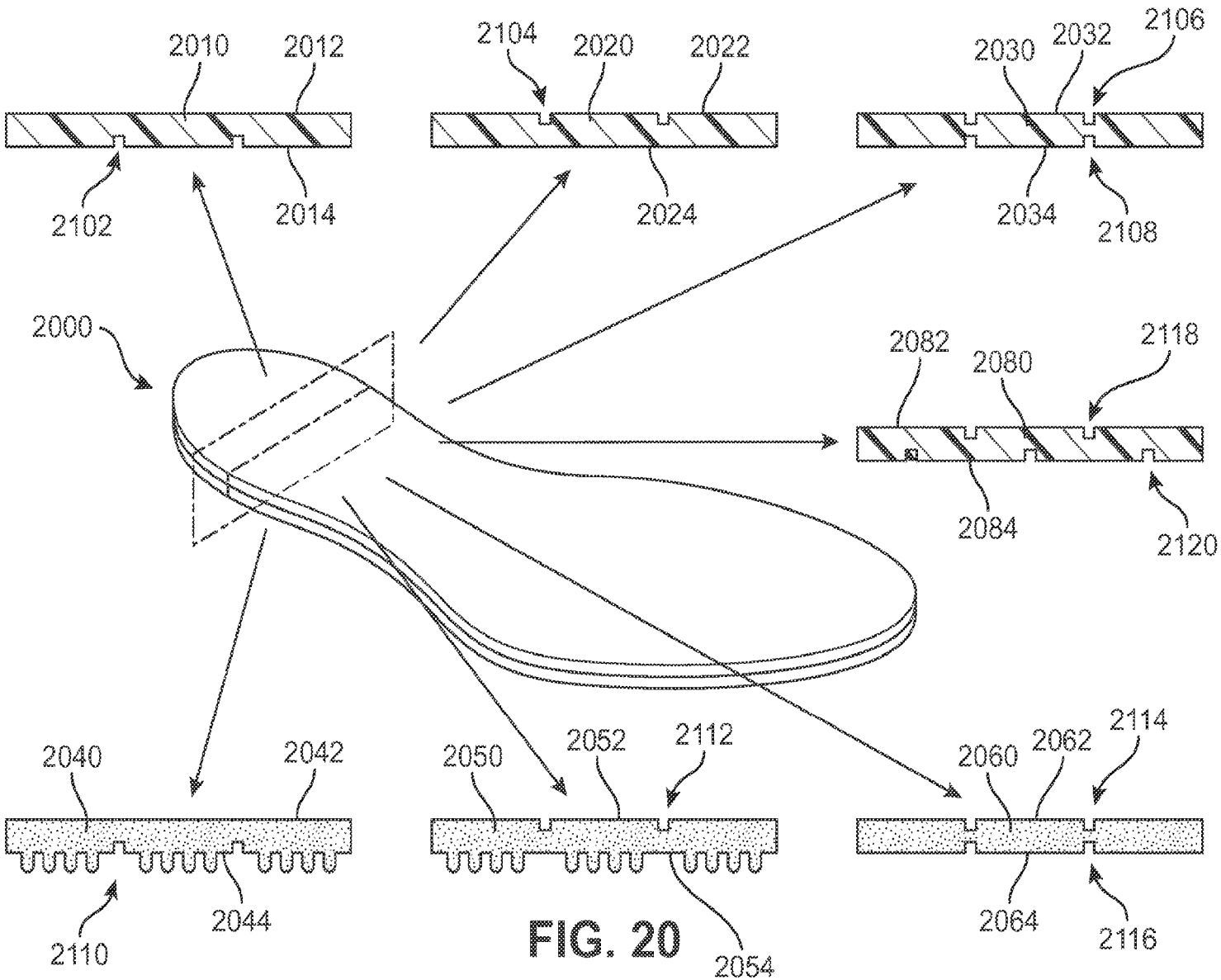
FIG. 20 is a schematic view of an embodiment of various different configurations for grooves in a midsole member and an outsole member of a sole structure.

FIG. 20 illustrates a schematic view of an embodiment of a sole structure 2000 that incorporates a midsole member and an outsole member. In particular, FIG. 20 illustrates several different possible configurations of grooves on a midsole member and an outsole member for sole structure 2000. Each configuration includes representative grooves on either an inner and/or outer surface of a midsole member or an outsole member. For example, a first optional midsole member 2010 includes an inner midsole surface 2012 and an outer midsole surface 2014. In this case, a plurality of grooves 2102 are disposed on outer midsole surface 2014. A second optional midsole member 2020 includes an inner midsole surface 2022 and an outer midsole surface 2024. In this case, a plurality of grooves 2104 are disposed on inner midsole surface 2022. A third optional midsole member 2030 includes an inner midsole surface 2032 and an outer midsole surface 2034. In this case, a plurality of grooves 2106 are disposed on inner midsole surface 2032 and a plurality of grooves 2108 are disposed on outer midsole surface 2034.

Embodiments may include midsole grooves on inner and outer surfaces which may not be aligned. A fourth optional midsole 2080, for example, includes inner midsole surface 2082 and outer midsole surface 2084. In this case, plurality of grooves 2118 are disposed on inner midsole surface 2082 while plurality of grooves 2120 are disposed on outer midsole surface 2084. However, unlike optional midsole member 2030, plurality of grooves 2118 and plurality of grooves 2120 are non-overlapping (i.e., not aligned). In some cases, the flexing properties of a midsole member can be varied by using non-overlapping grooves on an inner midsole surface and an outer midsole surface.

A first optional outsole member 2040 includes an inner outsole surface 2042 and an outer outsole surface 2044. In this case, a plurality of grooves 2110 are disposed on outer outsole surface 2044. A second optional outsole member 2050 includes an inner outsole surface 2052 and an outer outsole surface 2054. In this case, a plurality of grooves 2112 are disposed on inner outsole surface 2052. A third optional outsole member 2060 includes an inner outsole surface 2062 and an outer outsole surface 2064. In this case, a plurality of grooves 2114 are disposed on inner outsole surface 2062 and a plurality of grooves 2116 are disposed on outer outsole surface 2064.

It is contemplated that embodiments could use any combination of the options for grooves in a midsole and grooves in an outsole disclosed herein, as well as possibly other combinations not described here. For example, another embodiment could use grooves on both sides of the midsole member (as in optional midsole member 2030) and grooves on the outer side of the outsole member (as in optional outsole member 2040). Such a combination may allow for more flexibility in the midsole than the outsole. Still further combinations could be used. The configuration for the placement of midsole grooves and outsole grooves may be selected according to factors include desired flexibility, ease of manufacturing, durability as well as possibly other factors.

Figure 21:
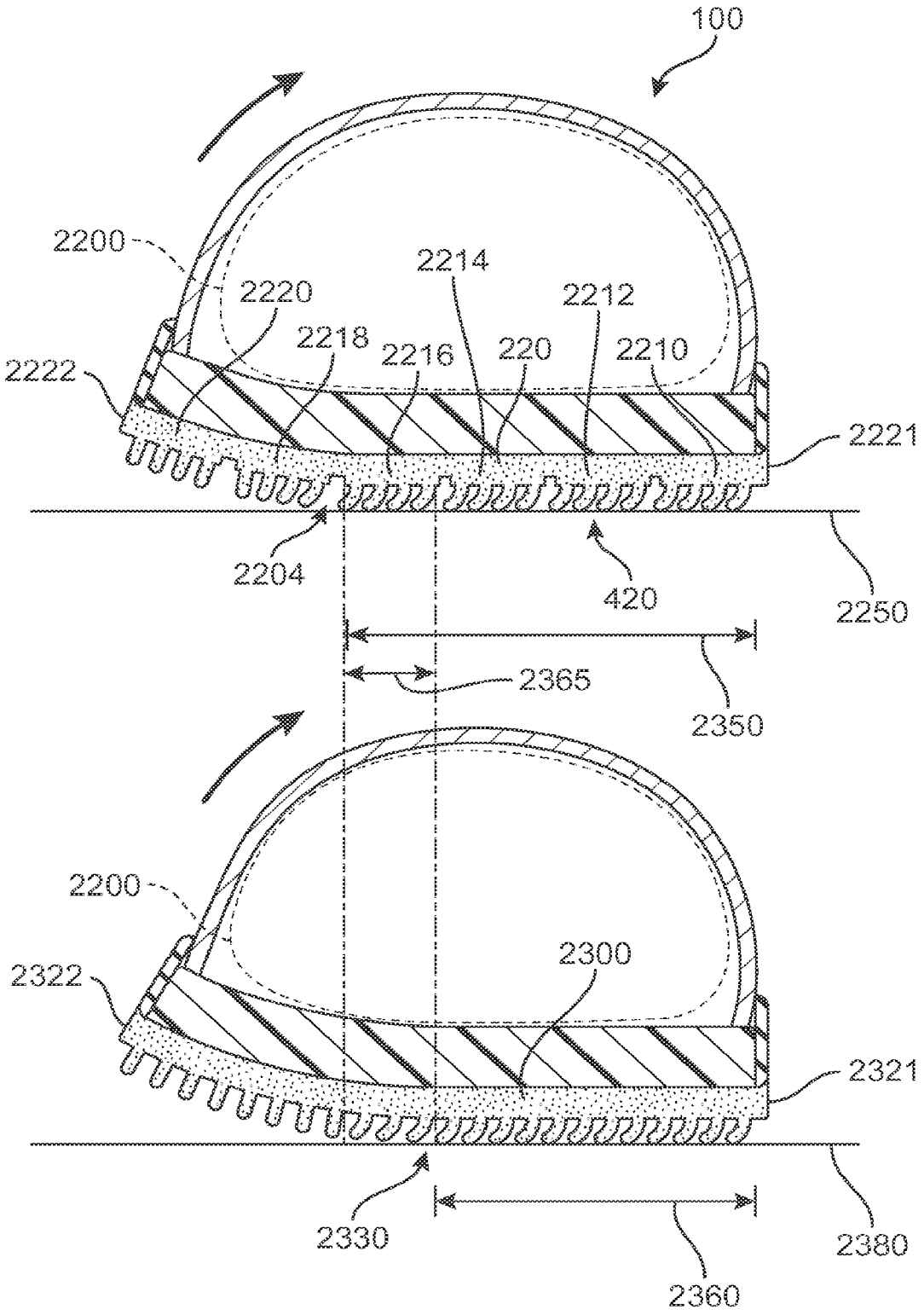
FIG. 21 is a schematic cross-sectional view of two sole structures bending according to an exemplary embodiment.

FIG. 21 illustrates schematic cross-sectional views of two different sole structures undergoing bending as a user makes a cut. In both cases, the user may make a cut in a medial direction (thereby lifting the lateral side of the article away from the ground). Referring to FIG. 21, article 100 is configured with outsole member 220 that may bend at one or more outsole grooves. In this case, foot 2200 acts to pull lateral side 2222 of outsole member 220 thereby causing outsole member 220 to bend at outsole groove 2204. In this cross-sectional view, four traction regions (first traction region 2210, second traction region 2212, third traction region 2214 and fourth traction region 2216) remain in contact with ground surface 2250. Moreover, the plurality of bristle members 420 engage ground surface 2250 to maintain good traction during the cut. In contrast, fifth traction region 2218 and sixth traction region 2220 are raised away from ground surface 2250.

FIG. 21 also illustrates an alternative embodiment of an outsole member 2300 undergoing a similar bending motion to outsole member 220 as outsole member 2300 contacts a ground surface 2380. However, outsole member 2300 lacks any grooves and therefore undergoes more uniform bending, rather than bending at predefined locations corresponding to grooves. Although both outsole member 2300 and outsole member 220 undergo similar lifting forces at their lateral sides, the lack of grooves in outsole member 2300 causes outsole member 2300 to lift away from ground surface 2380 at a different horizontal location than outsole member 220 lifts away from ground surface 2250. Specifically, outsole member 220 bends and lifts away from ground surface 2250 at outsole groove 2204. In contrast, outsole member 2300, due to the uniform bending, begins lifting from ground surface 2380 at a horizontal location 2330. Since outsole groove 2204 is relatively closer to lateral edge 2222 of outsole member 220 than horizontal location 2330 is from lateral edge 2332 of outsole member 2300, this results in a larger portion of outsole member 220 maintaining contact with the ground surface compared to the portion of outsole member 2300 in contact with ground surface 2380. In particular, distance 2350 represents the horizontal cross-sectional distance over which outsole member 220 makes contact with ground surface 2250 during bending (e.g., the distance from medial edge 2221 to outsole groove 2204) while distance 2360 represents the horizontal cross-sectional distance over which outsole member 2300 makes contact with ground surface 2380 (e.g., the distance from medial edge 2321 of outsole member 2300 to horizontal location 2330. As seen in FIG. 21, distance 2350 is greater than distance 2360 by a distance 2365. Thus, it is clear that outsole member 220 maintains a larger contact area (represented here by a linear distance along one dimension) with ground surface 2250 than outsole member 2300 maintains with ground surface 2380, even though the two outsole members are experiencing substantially identical forces. Thus, it can be seen that the use of grooves to form discrete traction regions with bristle members can help enhance traction of an outsole member.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper and a sole structure, the sole structure further including a midsole member and an outsole member, with an exterior support member located between the midsole member and the outsole member and extending around an exterior of at least some portions of the midsole member, the exterior support member including a raised sidewall portion that extends around an outer perimeter portion of the midsole member;

the midsole member having a first midsole surface and a second midsole surface, wherein the midsole member has a first thickness;

the outsole member having a first outsole surface and a second outsole surface, wherein the outsole member has a second thickness, wherein the thickness of the midsole member is thicker than the thickness of the outsole member;

the first midsole surface including an outer peripheral region and a central region disposed inwardly of the outer peripheral region; and the exterior support member further including a reinforcing member disposed only on a lateral side of a forefoot portion of the raised sidewall portion of the exterior support member, wherein the reinforcing member is substantially stiffer than the exterior support member.

2. The article of footwear according to claim 1, wherein the second midsole surface is disposed closer to the outsole member than the first midsole surface and the first outsole surface is disposed closer to the midsole member than the second outsole surface.

3. The article of footwear according to claim 2, wherein the midsole member includes a plurality of midsole grooves configured in a midsole grid on the first midsole surface and the outsole surface includes a plurality of outsole grooves configured in an outsole grid on the second outsole surface, wherein the midsole grid corresponds to the outsole grid with a matching groove pattern, wherein the midsole grid and the corresponding outsole grid provide multi-directional bending for the sole structure.

4. The article of footwear according to claim 3, wherein the outsole grid on the first midsole surface is disposed in the central region in a forefoot portion of the midsole member.

5. The article of footwear according to claim 4, wherein the central region of the midsole member has a thickness, wherein the first midsole groove has a depth and wherein the depth is less than the thickness.

6. The article of footwear according to claim 1, the midsole member including a first midsole groove disposed in the first midsole surface and the midsole member including a second midsole groove disposed in the first midsole surface, wherein the first midsole groove intersects the second midsole groove, wherein a first end of the first midsole groove is disposed in the central region and wherein a second end of the first midsole groove is disposed in the central region, and further wherein a first end of the second midsole groove is disposed in the central region and wherein a second end of the second midsole groove is disposed in the central region.

7. The article of footwear according to claim 6, the outsole member including a first outsole groove disposed in the second outsole surface and the outsole member including a second outsole groove disposed in the second outsole surface, wherein the first outsole groove intersects the second outsole groove.

8. An article of footwear, comprising:

an upper and a sole structure, the sole structure further comprising a midsole member and an exterior support member;

the exterior support member including a raised sidewall portion that extends around an outer perimeter portion of the midsole member;

the midsole member having a surface including a plurality of grooves;

the midsole member having a first stiffness and the exterior support member having a second stiffness; and wherein the second stiffness is greater than the first stiffness, the exterior support member further including a reinforcing member disposed only on a lateral side of a forefoot portion of the raised sidewall portion of the exterior support member, wherein the reinforcing member is substantially stiffer than the exterior support member.

9. The article of footwear according to claim 8, wherein the midsole member has a non-groove portion and a groove from the plurality of grooves, and wherein the non-groove portion is stiffer than the groove.

10. The article of footwear according to claim 8, wherein sole structure has a vertical direction extending perpendicular to a plane defined by a first direction and a second direction, wherein the raised sidewall portion extends vertically around a lower periphery of the upper and perpendicular to a longitudinal direction and a lateral direction so that the raised sidewall portion is higher than the surface on the midsole.

11. The article of footwear according to claim 8, wherein the exterior support member is made of a first material, wherein the midsole member is made of a second material, and wherein the first material is different from the second material.

12. The article of footwear according to claim 11, wherein the first material is a plastic material and wherein the second material is a foam material.

13. The article of footwear according to claim 8, wherein the midsole member includes a plurality of midsole grooves configured in a midsole grid on a top surface on the midsole and an inner surface of the exterior support member includes a plurality of grooves configured in an grid on the inner surface of the exterior support member, wherein the midsole grid corresponds to the grid on the inner surface of the exterior support member with a matching groove pattern, wherein the midsole grid and the corresponding grid on the inner surface of the exterior support member provide multi-directional bending for the sole structure.

14. An article of footwear, comprising:

an upper and a sole structure, the sole structure further comprising a midsole member and an outsole member, with an exterior support member located between the midsole member and the outsole member and extending around an exterior of at least some portions of the midsole member, the exterior support member including a raised sidewall portion that extends around an outer perimeter portion of the midsole member;

the outsole member having an inner outsole surface and an outer outsole surface, the outer outsole surface being disposed further from an interior cavity of the upper than the inner outsole surface; and the exterior support member further including a reinforcing member disposed only on a lateral side of a forefoot portion of the raised sidewall portion of the exterior support member, wherein the reinforcing member is substantially stiffer than the exterior support member.

15. The article of footwear according to claim 14, wherein the midsole member includes a plurality of midsole grooves configured in a midsole grid on a top surface on the midsole and the outsole surface includes a plurality of outsole grooves configured in an outsole grid on the outsole surface, wherein the midsole grid corresponds to the outsole grid with a matching groove pattern, wherein the midsole grid and the corresponding outsole grid provide multi-directional bending for the sole structure.

16. The article of footwear according to claim 14, further including a first outsole groove and a second outsole groove arranged in an approximately parallel configuration, and a third outsole groove and a fourth outsole groove arranged in an approximately parallel configuration, wherein the first outsole groove intersects the third outsole groove and the fourth outsole groove and wherein the second outsole groove intersects the third outsole groove and the fourth outsole groove and wherein a traction region of the outsole member is bounded by the first outsole groove, the second outsole groove, the third outsole groove and the fourth outsole groove.

17. The article of footwear according to claim 16, further including a plurality of bristle members disposed in the traction region on the outer outsole surface of the outsole member.

18. The article of footwear according to claim 17, wherein each bristle member in the plurality of bristle members extends in a normal direction in the absence of forces being applied to the bristle member, the normal direction being a direction that is approximately perpendicular to the outer outsole surface of the outsole member and wherein each bristle member in the plurality of bristle members bends away from the normal direction when a force is applied to the bristle member by a ground surface.

19. The article of footwear according to claim 17, wherein the plurality of bristle members are integrally formed with the outsole member.

20. The article of footwear according to claim 17, wherein the plurality of bristle members have rod-like geometries.

* * * * *